US007036584B2

(12) United States Patent
Zupanick et al.

(10) Patent No.: US 7,036,584 B2
(45) **Date of Patent: *May 2, 2006**

(54) METHOD AND SYSTEM FOR ACCESSING A SUBTERRANEAN ZONE FROM A LIMITED SURFACE AREA

(75) Inventors: Joseph A. Zupanick, Pineville, WV (US); Monty H. Rial, Dallas, TX (US)

(73) Assignee: CDX Gas, L.L.C., Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/188,141

(22) Filed: Jul. 1, 2002

(65) Prior Publication Data

US 2002/0189801 A1 Dec. 19, 2002

Related U.S. Application Data

(62) Division of application No. 09/774,996, filed on Jan. 30, 2001, now Pat. No. 6,662,870.

(51) Int. Cl.
*E21B 43/00* (2006.01)

(52) U.S. Cl. ..... 166/245; 166/50; 166/52

(58) Field of Classification Search ..... 166/243, 166/50, 52, 313, 245; 175/61, 62
See application file for complete search history.

(56) References Cited

U.S. PATENT DOCUMENTS

| | | | |
|---|---|---|---|
| 54,144 | A | 4/1866 | Hamar |
| 274,740 | A | 3/1883 | Douglass |
| 526,708 | A | 10/1894 | Horton |
| 639,036 | A | 12/1899 | Heald |

(Continued)

FOREIGN PATENT DOCUMENTS

| | | | |
|---|---|---|---|
| DE | 197 25 996 | A1 | 1/1998 |
| EP | 0 819 834 | A1 | 1/1998 |
| EP | 0 875 661 | A1 | 4/1998 |
| EP | 0 952.300 | A1 | 10/1999 |
| FR | 964503 | | 4/1944 ..... 8/1 |
| GB | 2 347 157 | A | 8/2000 |
| WO | 94/21889 | | 9/1994 |
| WO | WO 99/60248 | | 11/1999 |
| WO | WO 00/31376 | | 6/2000 |
| WO | WO 00/79099 | | 12/2000 |
| WO | WO 02/059455 | | 8/2002 |

OTHER PUBLICATIONS

Susan Eaton, "Reversal of Fortune", New Technology Magazine, pp. 30–31, Sep. 2002.

James Mahony, "A Shadow of Things to Come", New Technology Magazine, pp. 28–29, Sep. 2002.

Documents Received from Third Party, Great Lakes Directional Drilling, Inc., (12 pages), Received Sep. 12, 2002.

(Continued)

*Primary Examiner*—John Kreck
(74) *Attorney, Agent, or Firm*—Baker Botts L.L.P.

(57) ABSTRACT

A method and system for accessing subterranean resources from a limited surface area includes a first well bore extending from the surface to the target zone. The first well bore includes an angled portion disposed between the target zone and the surface to provide an offset between a surface location of the first well bore and an intersection of the first well bore with the subterranean resource. The system also includes an articulated well bore extending from the surface to the target zone. The articulated well bore is offset from the first well bore at the surface and intersects the first well bore proximate the target zone. The system further includes a well bore pattern extending from the intersection of the first well bore and the articulated well bore in the target zone to provide access to the target zone.

30 Claims, 11 Drawing Sheets

U.S. PATENT DOCUMENTS

| | | | | |
|---|---|---|---|---|
| 1,189,560 | A | 7/1916 | Gondos | |
| 1,285,347 | A | 11/1918 | Otto | |
| 1,467,480 | A | 9/1923 | Hogue | |
| 1,485,615 | A | 3/1924 | Jones | |
| 1,674,392 | A | 6/1928 | Flansburg | |
| 1,777,961 | A | 10/1930 | Capeliuschnicoff | |
| 2,018,285 | A | 10/1935 | Schweitzer et al. | 166/21 |
| 2,069,482 | A | 2/1937 | Seay | 255/76 |
| 2,150,228 | A | 3/1939 | Lamb | 166/10 |
| 2,169,718 | A | 8/1939 | Böll et al. | 255/24 |
| 2,335,085 | A | 11/1943 | Roberts | 251/197 |
| 2,450,223 | A | 9/1948 | Barbour | 255/76 |
| 2,490,350 | A | 12/1949 | Grable | 166/4 |
| 2,679,903 | A | 6/1954 | McGowen, Jr. et al. | 166/1 |
| 2,726,063 | A | 12/1955 | Ragland et al. | 255/1.8 |
| 2,726,847 | A | 12/1955 | McCune et al. | 255/1.6 |
| 2,783,018 | A | 2/1957 | Lytle | 251/25 |
| 2,847,189 | A | 8/1958 | Shook | 255/76 |
| 2,911,008 | A | 11/1959 | Bois | 137/625.31 |
| 2,980,142 | A | 4/1961 | Turak | 137/637.3 |
| 3,347,595 | A | 10/1967 | Dahms et al. | 299/4 |
| 3,443,648 | A | 5/1969 | Howard | 175/103 |
| 3,473,571 | A | 10/1969 | Dugay | 137/624.4 |
| 3,503,377 | A | 3/1970 | Beatenbough et al. | 123/117 |
| 3,528,516 | A | 9/1970 | Brown | 175/267 |
| 3,530,675 | A | 9/1970 | Turzillo | 61/35 |
| 3,684,041 | A | 8/1972 | Kammerer, Jr. et al. | 175/267 |
| 3,692,041 | A | 9/1972 | Bondi | 137/238 |
| 3,757,876 | A | 9/1973 | Pereau | 175/267 |
| 3,757,877 | A | 9/1973 | Leathers | 175/269 |
| 3,800,830 | A | 4/1974 | Etter | 137/625.41 |
| 3,809,519 | A | 5/1974 | Garner | 425/245 |
| 3,825,081 | A | 7/1974 | McMahon | 175/73 |
| 3,828,867 | A | 8/1974 | Elwood | 175/45 |
| 3,874,413 | A | 4/1975 | Valdez | 137/625.47 |
| 3,887,008 | A | 6/1975 | Canfield | 166/267 |
| 3,902,322 | A | 9/1975 | Watanabe | 61/35 |
| 3,934,649 | A | 1/1976 | Pasini, III et al. | 166/254 |
| 3,957,082 | A | 5/1976 | Fuson et al. | 137/625.41 |
| 3,961,824 | A | 6/1976 | Van Eek et al. | 299/17 |
| 4,011,890 | A | 3/1977 | Andersson | 137/625.4 |
| 4,022,279 | A | 5/1977 | Driver | 166/271 |
| 4,037,658 | A | 7/1977 | Anderson | 166/272 |
| 4,073,351 | A | 2/1978 | Baum | 175/14 |
| 4,089,374 | A | 5/1978 | Terry | 166/259 |
| 4,116,012 | A | 9/1978 | Abe et al. | 405/238 |
| 4,156,437 | A | 5/1979 | Chivens et al. | 137/554 |
| 4,169,510 | A | 10/1979 | Meigs | 175/65 |
| 4,189,184 | A | 2/1980 | Green | 299/8 |
| 4,220,203 | A | 9/1980 | Steeman | 166/271 |
| 4,221,433 | A | 9/1980 | Jacoby | 299/4 |
| 4,257,650 | A | 3/1981 | Allen | 299/2 |
| 4,278,137 | A | 7/1981 | Van Eek | 175/267 |
| 4,283,088 | A | 8/1981 | Tabakov et al. | 299/2 |
| 4,296,785 | A | 10/1981 | Vitello et al. | 141/105 |
| 4,299,295 | A | 11/1981 | Gossard | 175/45 |
| 4,305,464 | A | 12/1981 | Masszi | 166/370 |
| 4,312,377 | A | 1/1982 | Knecht | 137/625.19 |
| 4,317,492 | A | 3/1982 | Summers et al. | 175/79 |
| 4,328,577 | A | 5/1982 | Abbott et al. | 370/84 |
| 4,366,988 | A | 1/1983 | Bodine | 299/14 |
| 4,372,398 | A | 2/1983 | Kuckes | 175/45 |
| 4,386,665 | A | 6/1983 | Dellinger | 175/61 |
| 4,390,067 | A | 6/1983 | Willman | 166/245 |
| 4,396,076 | A | 8/1983 | Inoue | 175/265 |
| 4,397,360 | A | 8/1983 | Schmidt | 175/61 |
| 4,401,171 | A | 8/1983 | Fuchs | 175/267 |
| 4,407,376 | A | 10/1983 | Inoue | 175/267 |
| 4,442,896 | A | 4/1984 | Reale et al. | 166/278 |
| 4,494,616 | A | 1/1985 | McKee | 175/67 |
| 4,512,422 | A | 4/1985 | Knisley | 175/99 |
| 4,519,463 | A | 5/1985 | Schuh | 175/61 |
| 4,527,639 | A | 7/1985 | Kickinson, III et al. | 175/61 |
| 4,532,986 | A | 8/1985 | Mims et al. | 166/50 |
| 4,544,037 | A | 10/1985 | Terry | 166/369 |
| 4,558,744 | A | 12/1985 | Gibb | 166/335 |
| 4,565,252 | A | 1/1986 | Campbell et al. | 175/269 |
| 4,573,541 | A | 3/1986 | Jossee et al. | 175/78 |
| 4,599,172 | A | 7/1986 | Gardes | 210/314 |
| 4,600,061 | A | 7/1986 | Richards | 175/62 |
| 4,603,592 | A | 8/1986 | Siebold et al. | 74/41 |
| 4,605,076 | A | 8/1986 | Goodhart | 175/61 |
| 4,611,855 | A | 9/1986 | Richards | 299/2 |
| 4,618,009 | A | 10/1986 | Carter et al. | 175/267 |
| 4,638,949 | A | 1/1987 | Mancel | 239/307 |
| 4,646,836 | A | 3/1987 | Goodhart | 166/303 |
| 4,674,579 | A | 6/1987 | Geller et al. | 175/45 |
| 4,702,314 | A | 10/1987 | Huang et al. | 166/245 |
| 4,705,431 | A | 11/1987 | Gadelle et al. | 405/267 |
| 4,715,440 | A | 12/1987 | Boxell et al. | 166/100 |
| 4,754,819 | A | 7/1988 | Dellinger | 175/61 |
| 4,756,367 | A | 7/1988 | Puri et al. | 166/263 |
| 4,763,734 | A | 8/1988 | Dickinson et al. | 175/61 |
| 4,773,488 | A | 9/1988 | Bell et al. | 175/61 |
| 4,830,105 | A | 5/1989 | Petermann | 166/241 |
| 4,836,611 | A | 6/1989 | El-Saie | 299/7 |
| 4,842,081 | A | 6/1989 | Parant | 175/23 |
| 4,844,182 | A | 7/1989 | Tolle | 175/215 |
| 4,852,666 | A | 8/1989 | Brunet et al. | 175/61 |
| 4,883,122 | A | 11/1989 | Puri et al. | 166/263 |
| 4,978,172 | A | 12/1990 | Schwoebel et al. | 299/12 |
| 5,016,710 | A | 5/1991 | Renard et al. | 166/245 |
| 5,035,605 | A | 7/1991 | Dinerman et al. | 425/564 |
| 5,036,921 | A | 8/1991 | Pittard et al. | 166/298 |
| 5,074,360 | A | 12/1991 | Guinn | 166/281 |
| 5,074,365 | A | 12/1991 | Kuckes | 175/40 |
| 5,074,366 | A | 12/1991 | Karlsson et al. | 175/76 |
| 5,082,054 | A | 1/1992 | Kiamanesh | 166/248 |
| 5,111,893 | A | 5/1992 | Kvello-Aune | 175/258 |
| 5,121,244 | A | 6/1992 | Takasaki | 359/161 |
| 5,135,058 | A | 8/1992 | Millgard et al. | 175/71 |
| 5,148,875 | A | 9/1992 | Karlsson et al. | 175/62 |
| 5,165,491 | A | 11/1992 | Wilson | 175/62 |
| 5,168,942 | A | 12/1992 | Wydrinski | 175/50 |
| 5,174,374 | A | 12/1992 | Hailey | 166/55.8 |
| 5,193,620 | A | 3/1993 | Braddick | 166/382 |
| 5,194,859 | A | 3/1993 | Warren | 340/853.4 |
| 5,194,977 | A | 3/1993 | Nishio | 359/128 |
| 5,197,553 | A | 3/1993 | Leturno | 175/57 |
| 5,197,783 | A | 3/1993 | Theimer et al. | 299/17 |
| 5,199,496 | A | 4/1993 | Redus et al. | 166/366 |
| 5,201,817 | A | 4/1993 | Hailey | 175/269 |
| 5,217,076 | A | 6/1993 | Masek | 166/303 |
| 5,240,350 | A | 8/1993 | Yamaguchi et al. | 405/143 |
| 5,242,017 | A | 9/1993 | Hailey | 166/55.8 |
| 5,246,273 | A | 9/1993 | Rosar | 299/4 |
| 5,255,741 | A | 10/1993 | Alexander | 166/278 |
| 5,271,472 | A | 12/1993 | Leturno | 175/107 |
| 5,301,760 | A | 4/1994 | Graham | 175/61 |
| 5,363,927 | A | 11/1994 | Frank | 175/67 |
| 5,385,205 | A | 1/1995 | Hailey | 166/55.8 |
| 5,394,950 | A | 3/1995 | Gardes | 175/45 |
| 5,402,851 | A | 4/1995 | Baiton | 166/369 |
| 5,411,082 | A | 5/1995 | Kennedy | 166/181 |
| 5,411,085 | A | 5/1995 | Moore et al. | 166/242 |
| 5,411,104 | A | 5/1995 | Stanley | 175/65 |
| 5,411,105 | A | 5/1995 | Gray | 175/69 |
| 5,431,220 | A | 7/1995 | Lennon et al. | 166/55.7 |
| 5,435,400 | A | 7/1995 | Smith | 175/61 |
| 5,447,416 | A | 9/1995 | Wittrisch | 417/442 |
| 5,450,902 | A | 9/1995 | Matthews | 166/268 |

| | | | | |
|---|---|---|---|---|
| 5,454,419 | A | 10/1995 | Vloedman | 166/277 |
| 5,458,209 | A | 10/1995 | Hayes et al. | 175/61 |
| 5,462,116 | A | 10/1995 | Carroll | 166/249 |
| 5,462,120 | A | 10/1995 | Gondouin | 166/380 |
| 5,469,155 | A | 11/1995 | Archambeault et al. | 340/853.4 |
| 5,477,923 | A | 12/1995 | Jordan, Jr. et al. | 66/313 |
| 5,485,089 | A | 1/1996 | Kuckes | 324/346 |
| 5,494,121 | A | 2/1996 | Nackerud | 175/263 |
| 5,499,687 | A | 3/1996 | Lee | 175/317 |
| 5,501,273 | A | 3/1996 | Puri | 166/252.5 |
| 5,501,279 | A | 3/1996 | Garg et al. | 166/372 |
| 5,584,605 | A | 12/1996 | Beard et al. | 405/128 |
| 5,615,739 | A | 4/1997 | Dallas | 166/306 |
| 5,659,347 | A | 8/1997 | Taylor | 347/85 |
| 5,669,444 | A | 9/1997 | Riese et al. | 166/263 |
| 5,680,901 | A | 10/1997 | Gardes | 166/313 |
| 5,690,390 | A | 11/1997 | Bithell | 299/4 |
| 5,706,871 | A | 1/1998 | Andersson et al. | 141/59 |
| 5,720,356 | A | 2/1998 | Gardes | 175/62 |
| 5,727,629 | A | 3/1998 | Blizzard, Jr. et al. | 166/298 |
| 5,735,350 | A | 4/1998 | Longbottom et al. | 166/313 |
| 5,771,976 | A | 6/1998 | Talley | 166/370 |
| 5,785,133 | A | 7/1998 | Murray et al. | 175/61 |
| 5,832,958 | A | 11/1998 | Cheng | 137/625.41 |
| 5,852,505 | A | 12/1998 | Li | 359/118 |
| 5,853,054 | A | 12/1998 | McGarian et al. | 175/267 |
| 5,853,056 | A | 12/1998 | Landers | 175/424 |
| 5,863,283 | A | 1/1999 | Gardes | 588/250 |
| 5,867,289 | A | 2/1999 | Gerstel et al. | 359/110 |
| 5,868,202 | A | 2/1999 | Hsu | 166/256 |
| 5,868,210 | A | 2/1999 | Johnson et al. | 175/40 |
| 5,879,057 | A | 3/1999 | Schwoebel et al. | 299/17 |
| 5,884,704 | A | 3/1999 | Longbottom et al. | 16/313 |
| 5,912,754 | A | 6/1999 | Koga et al. | 359/179 |
| 5,914,798 | A | 6/1999 | Liu | 359/161 |
| 5,917,325 | A | 6/1999 | Smith | 324/326 |
| 5,934,390 | A | 8/1999 | Uthe | 175/67 |
| 5,957,539 | A | 9/1999 | Durup et al. | 299/4 |
| 6,012,520 | A | 1/2000 | Yu et al. | 166/245 |
| 6,024,171 | A | 2/2000 | Montgomery et al. | 166/308 |
| 6,050,335 | A | 4/2000 | Parsons | 166/272.3 |
| 6,056,059 | A | 5/2000 | Ohmer | 166/313 |
| 6,065,550 | A | 5/2000 | Gardes | 175/62 |
| 6,119,771 | A | 9/2000 | Gano et al. | 166/50 |
| 6,135,208 | A | 10/2000 | Gano et al. | 166/313 |
| 6,280,000 | B1 | 8/2001 | Zupanick | 299/12 |
| 6,349,769 | B1 | 2/2002 | Ohmer | 166/313 |
| 6,357,523 | B1 | 3/2002 | Zupanick | 299/12 |
| 6,425,448 | B1 * | 7/2002 | Zupanick et al. | 175/61 |
| 6,439,320 | B1 * | 8/2002 | Zupanick | 175/61 |
| 6,454,000 | B1 * | 9/2002 | Zupanick | 166/243 |
| 6,478,085 | B1 * | 11/2002 | Zupanick | 166/50 |

OTHER PUBLICATIONS

R.J. "Bob" Stayton, Horizontal Wells Boost CBM Recovery, The American & Oil Gas Reporter, pp. 71–75, Aug. 2002.

Robert W. Taylor and Richard Russell, Multilateral Technologies Increase Operational Efficiencies in Middle East, Oil & Gas Journal, pp. 76–80, Mar. 16, 1998.

Adam Pasiczynk, "Evolution Simplifies Multilateral Wells", Directional Drilling, pp. 53–55, Jun. 2000.

Steven S. Bell, "Multilateral System with Full Re–Entry Access Installed", World Oil, p. 29, Jun. 1996.

P. Jackson and S. Kershaw, Reducing Long Term Methane Emissions Resulting from Coal Mining, Energy Convers. Mgmt, vol. 37, Nos 6–8, pp. 801–806, 1996.

Pascal Breant, "Des Puits Branches, Chez Total : les puits multi drains", Total Exploration Production, pp. 1–5, Jan. 1999.

Arfon H. Jones et al., "A Review of the Physical and Mechanical Properties of Coal with Implications for Coal–Bed Methane Well Completion and Production", *Rocky Mountain Association of Geologists*, pp 169–181, 1988.

Joseph C. Stevens, Horizontal Applications for Coal Bed Methane Recovery, 3rd Annual Coalbed and Coal Mine Conference, *Strategic Research Institute*, pp 1–10 slides, Mar. 25, 2002.

R.J. "Bob" "Horizontal Wells Boost CBM Recovery", Special Report: Horizontal & Directional Drilling, *The American Oil & Gas Reporter*, pp. 71–75, Aug. 2002.

Kelley et al., U.S. patent application Publication, Pub. No. US 2002/0074122 A1, Method and Apparatus for Hydrocarbon Subterranean Recovery, Jun. 20, 2002.

Joseph A. Zupanick; Declaration of Experimental Use, pp 1–3, Nov. 14, 2000.

Howard L. Hartman, et al.; "*SME Mining Engineering Handbook*;" Society for Mining, Metallurgy, and Exploration, Inc.; pp 1946–1950, 2nd Edition, vol. 2, 1992.

Dave Hassan, Mike Chernichen, Earl Jensen, and Morley Frank; "*Multi–lateral technique lowers drilling costs, provides environmental benefits*", Drilling Technology, pp 41–47, Oct. 1999.

Pending patent application, Joseph A. Zupanick, *Method and System for Accessing Subterranean Deposits from the Surface*, Ser. No. 09/789,956, filed Feb. 20, 2001.

Pending patent application, Joseph A. Zupanick, *Method and System for Accessing Subterranean Deposits from the Surface*, Ser. No. 09/788,897, filed Feb. 20, 2001.

Pending patent application, Joseph A. Zupanick, *Method and System for Accessing Subterranean Deposits from the Surface*, Ser. No. 09/791,033, filed Feb. 20, 2001.

McCray and Cole, "*Oil Well Drilling and Technology*," University of Oklahoma Press, pp 315–319, 1959.

Berger and Anderson, "*Modern Petroleum*;" Penn Well Books, pp 106–108, 1978.

Pending patent application, Joseph A. Zupanick, "*Cavity Well Positioning System and Method*," Ser. No. 09/696,338, Oct. 24, 2000.

Pending patent application, Joseph A. Zupanick, "*Method and System for Accessing A Subterrean Zone from a Limited Surface Area*," Ser. No. 09/773,217, Jan. 30, 2001.

Pending Patent Application, Joseph A. Zupanick, "*Method and System for Enhanced Access to a Subterrean Zone*," Ser. No. 09/769,098, Jan. 24, 2001.

Gopal Ramaswamy, "*Production History Provides CBM Insights*, " Oil & Gas Journal, pp. 49, 50 & 52, Apr. 2, 2001.

Pend. Pat. App. Joseph A. Zupanick, "*Method and System for Accessing Subterranean Deposits From the Surface*, " SN 09/885,219 (067083.0140), Filed Jun. 20, 2001.

Weiguo Chi & Luwu Yang, "*Feasibility of Coalbed Methane Exploitation in China*, " Horizontal Well Technology, p. 74, Sep. 2001.

Pend. Pat. App. Joseph A. Zupanick et al., "*Method and System for Management of By–Products From Subterranean Zones*," SN 10/046,001 (067083.0134), Oct. 19, 2001.

Nakerud Product Description, Sep. 27, 2001.

Gopal Ramaswamy,"*Advances Key For Coalbed Methane*," The American Oil & Gas Reporter, pp. 71 & 73, Oct. 2001.

* cited by examiner

METHOD AND SYSTEM FOR ACCESSING A SUBTERRANEAN ZONE FROM A LIMITED SURFACE AREA

CROSS-REFERENCE TO RELATED APPLICATION

This application is a divisional of U.S. application Ser. No. 09/774,996, filed Jan. 30, 2001, by Joseph A. Zupanick and Monty H. Rial, entitled "Method and System for Accessing a Subterranean Zone from a Limited Surface Area," now U.S. Pat. No. 6,662,870.

TECHNICAL FIELD OF THE INVENTION

The present invention relates generally to the field of subterranean exploration and drilling and, more particularly, to a method and system for accessing a subterranean zone from a limited surface area.

BACKGROUND OF THE INVENTION

Subterranean deposits of coal, whether of "hard" coal such as anthracite or "soft" coal such as lignite or bituminous coal, contain substantial quantities of entrained methane gas. Limited production and use of methane gas from coal deposits has occurred for many years. Substantial obstacles have frustrated more extensive development and use of methane gas deposits in coal seams. The foremost problem in producing methane gas from coal seams is that while coal seams may extend over large areas, up to several thousand acres, the coal seams are fairly shallow in depth, varying from a few inches to several meters. Thus, while the coal seams are often relatively near the surface, vertical wells drilled into the coal deposits for obtaining methane gas can only drain a fairly small radius around the coal deposits. Further, coal deposits are not amenable to pressure fracturing and other methods often used for increasing methane gas production from rock formations. As a result, once the gas easily drained from a vertical well bore in a coal seam is produced, further production is limited in volume. Additionally, coal seams are often associated with subterranean water, which must be drained from the coal seam in order to produce the methane.

Prior systems and methods generally require a fairly level surface area from which to work. As a result, prior systems and methods generally cannot be used in Appalachia or other hilly terrains. For example, in some areas the largest area of flat land may be a wide roadway. Thus, less effective methods must be used, leading to production delays that add to the expense associated with degasifying a coal seam. Additionally, prior systems and methods generally require fairly large working surface area. Thus, many subterranean resources are inaccessible because of current mining techniques and the geographic limitations surrounding the resource. Additionally, potential disruption or devastation to the environment surrounding the subterranean resources often prevents the mining of many subterranean resources.

SUMMARY OF THE INVENTION

The present invention provides a method and system for accessing subterranean deposits from a limited surface area that substantially eliminates or reduces the disadvantages and problems associated with previous systems and methods.

In accordance with one embodiment of the present invention, a system for accessing a subsurface formation from a limited surface area includes a first well bore extending from the surface to a target zone. The first well bore includes an angled portion disposed between the target zone and the surface. The system also includes a second well bore extending from the surface to the target zone. The second well bore is offset from the first well bore at the surface and intersects the first well bore at a junction proximate the target zone. The system further includes a well bore pattern extending from the junction into the target zone.

In accordance with another embodiment of the present invention, a method for accessing a subsurface formation from a limited surface area includes forming a first well bore extending from the surface to a target zone. The first well bore includes an angled portion disposed between the target zone and the surface. The method also includes forming a second well bore extending from the surface to the target zone. The second well bore is offset from the first well bore at the surface and intersects the first well bore at a junction proximate the target zone. The method further includes forming a well bore pattern extending from the junction into the target zone.

Technical advantages of the present invention include providing an improved method and system for accessing subterranean deposits from a limited area on the surface. In particular, a well bore pattern is drilled in a target zone from an articulated surface well at least in close proximity to another or second surface well. The second surface well includes an angled portion to accommodate location of the second surface well in close proximity to the articulated well while providing an adequate distance at the target zone between the second surface well and the articulated well to accommodate the radius of the articulated well. The well bore pattern is interconnected to the second surface well through which entrained water, hydrocarbons, and other fluids drained from the target zone can be efficiently removed and/or produced. The well bore pattern may also be used to inject or introduce a fluid or substance into the subterranean formation. As a result, gas, oil, and other fluids from a large, low pressure or low porosity formation can be efficiently produced at a limited area on the surface. Thus, gas may be recovered from formations underlying rough topology. In addition, environmental impact is minimized as the area to be cleared and used is minimized.

Yet another technical advantage of the present invention includes providing an improved method and system for preparing a coal seam or other subterranean deposit for mining and for collecting gas from the seam after mining operations. In particular, a surface well, with a vertical portion, an articulated portion, and a cavity, is used to degasify a coal seam prior to mining operations. This reduces both needed surface area and underground equipment and activities. This also reduces the time needed to degasify the seam, which minimizes shutdowns due to high gas content. In addition, water and additives may be pumped into the degasified coal seam through the combined well prior to mining operations to minimize dust and other hazardous conditions, to improve efficiency of the mining process, and to improve the quality of the coal product. After mining, the combined well is used to collect gob gas. As a result, costs associated with the collection of gob gas are minimized to facilitate or make feasible the collection of gob gas from previously mined seams.

Other technical advantages of the present invention will be readily apparent to one skilled in the art from the following figures, description, and claims.

BRIEF DESCRIPTION OF THE DRAWINGS

For a more complete understanding of the present invention and its advantages, reference is now made to the following description taken in conjunction with the accompanying drawings, wherein like numerals represent like parts, in which.

DETAILED DESCRIPTION OF THE INVENTION

Figure 1:
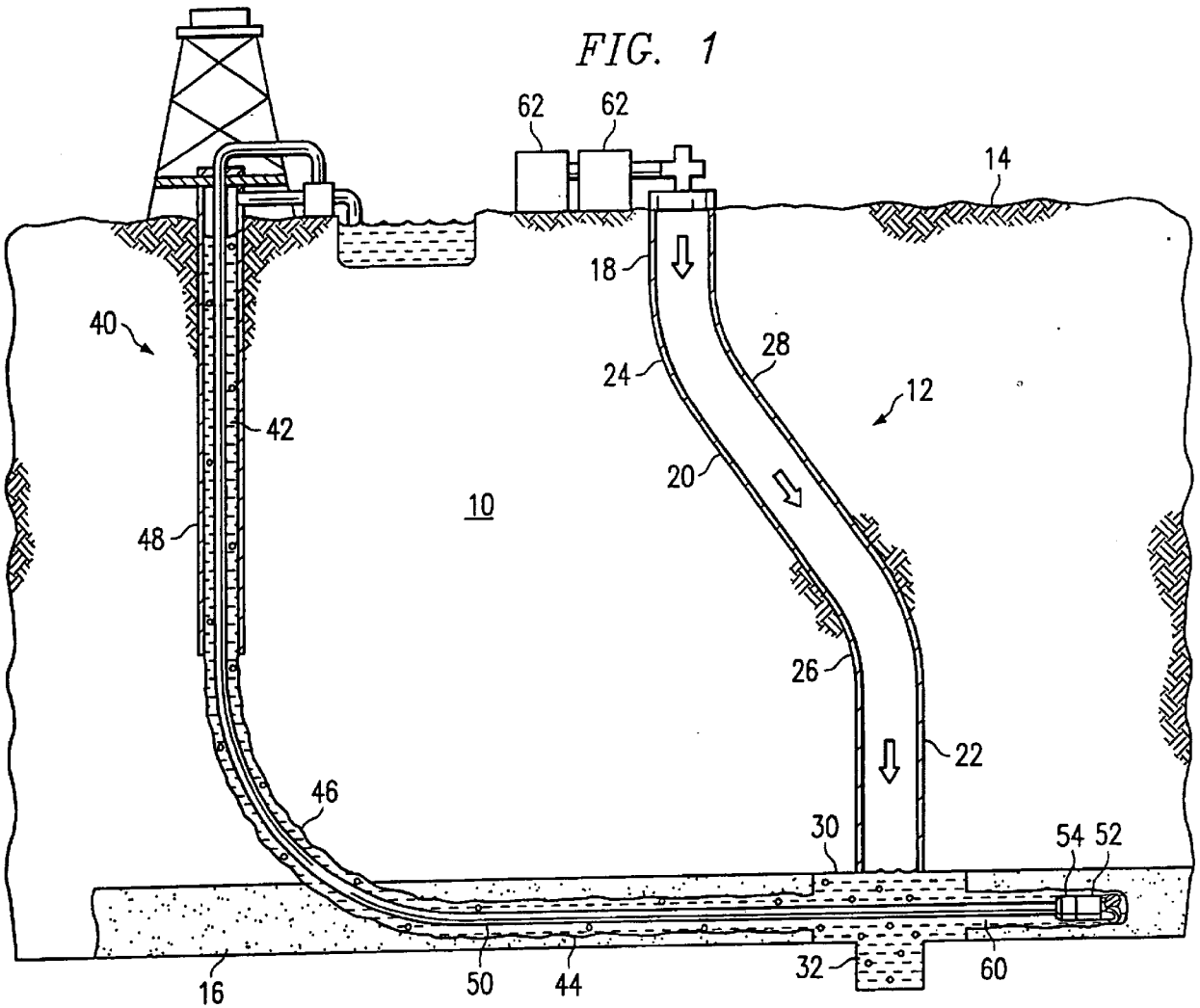
FIG. 1 is a cross-sectional diagram illustrating a system for accessing a subterranean zone from a limited surface area in accordance with an embodiment of the present invention.

FIG. 1 is a diagram illustrating a system 10 for accessing a subterranean zone from a limited surface area in accordance with an embodiment of the present invention. In this embodiment, the subterranean zone is a coal seam. However, it should be understood that other subterranean formations and/or other low pressure, ultra-low pressure, and low porosity subterranean zones can be similarly accessed using the system 10 of the present invention to remove and/or produce water, hydrocarbons and other fluids in the zone, to treat minerals in the zone prior to mining operations, or to inject, introduce, or store a gas, fluid or other substance into the zone.

Referring to FIG. 1, a well bore 12 extends from the surface 14 to a target coal seam 16. The well bore 12 intersects, penetrates and continues below the coal seam 16. In the embodiment illustrated in FIG. 1, the well bore 12 includes a portion 18, an angled portion 20, and a portion 22 disposed between the surface 14 and the coal seam 16. IN FIG. 1, portions 18 and 22 are illustrated substantially vertical; however, it should be understood that portions 18 and 22 may be formed at other suitable angles and orientations to accommodate surface 14 and/or coal seam 16 variations.

In this embodiment, the portion 18 extends downwardly in a substantially vertical direction from the surface 14 a predetermined distance to accommodate formation of radiused portions 24 and 26, angled portion 20, and portion 22 to intersect the coal seam 16 at a desired location. Angled portion 20 extends from an end of the portion 18 and extends downwardly at a predetermined angle relative to the portion 18 to accommodate intersection of the coal seam 16 at the desired location. Angled portion 20 may be formed having a generally uniform or straight directional configuration or may include various undulations or radiused portions as required to intersect portion 22 and/or to accommodate various subterranean obstacles, drilling requirements or characteristics. Portion 22 extends downwardly in a substantially vertical direction from an end of the angled portion 20 to intersect, penetrate and continue below the coal seam 16.

In one embodiment, to intersect a coal seam 16 located at a depth of approximately 1200 feet below the surface 14, the portion 18 may be drilled to a depth of approximately 300 feet. Radiused portions 24 and 26 may be formed having a radius of approximately 400 feet, and angled portion 20 may be tangentially formed between radiused portions 24 and 26 at an angle relative to the portion 18 to accommodate approximately a 250 foot offset between portions 18 and 22 at a depth of approximately 200 feet above the target coal seam 16. The portion 22 may be formed extending downwardly the remaining 200 feet to the coal seam 16. However, other suitable drilling depths, drilling radii, angular orientations, and offset distances may be used to form well bore 12. The well bore 12 may also be lined with a suitable well casing 28 that terminates at or above the upper level of the coal seam 16.

The well bore 12 is logged either during or after drilling in order to locate the exact vertical depth of the coal seam 16. As a result, the coal seam 16 is not missed in subsequent drilling operations, and techniques used to locate the coal seam 16 while drilling need not be employed. An enlarged cavity 30 is formed in the well bore 12 at the level of the coal seam 16. As described in more detail below, the enlarged cavity 30 provides a junction for intersection of the well bore 12 by an articulated well bore used to form a subterranean well bore pattern in the coal seam 16. The enlarged cavity 30 also provides a collection point for fluids drained from the coal seam 16 during production operations. In one embodiment, the enlarged cavity 30 has a radius of approximately eight feet and a vertical dimension which equals or exceeds the vertical dimension of the coal seam 16. The enlarged cavity 30 is formed using suitable under-reaming techniques and equipment. Portion 22 of the well bore 12 continues below the enlarged cavity 30 to form a sump 32 for the cavity 30.

An articulated well bore 40 extends from the surface 14 to the enlarged cavity 30. In this embodiment, the articulated well bore 40 includes a portion 42, a portion 44, and a curved or radiused portion 46 interconnecting the portions 42 and 44. The portion 44 lies substantially in the plane of the coal seam 16 and intersects the enlarged cavity 30. In FIG. 1, portion 42 is illustrated substantially vertical, and portion 44 is illustrated substantially horizontal; however, it should be understood that portions 42 and 44 may be formed having other suitable orientations to accommodate surface 14 and/or coal seam 16 characteristics.

In the illustrated embodiment, the articulated well bore 40 is offset a sufficient distance from the well bore 12 at the surface 14 to permit the large radius curved portion 46 and any desired distance of portion 44 to be drilled before intersecting the enlarged cavity 30. In one embodiment, to provide the curved portion 46 with a radius of 100–150 feet, the articulated well bore 40 is offset a distance of approximately 300 feet from the well bore 12 at the surface 14. This spacing minimizes the angle of the curved portion 46 to reduce friction in the articulated well bore 40 during drilling operations. As a result, reach of the articulated drill string drilled through the articulated well bore 40 is maximized. However, other suitable offset distances and radii may be used for forming the articulated well bore 40. The portion 42 of the articulated well bore 40 is lined with a suitable casing 48.

The articulated well bore 40 is drilled using an articulated drill string 50 that includes a suitable down-hole motor and bit 52. A measurement while drilling (MWD) device 54 is included in the articulated drill string 50 for controlling the orientation and direction of the well bore drilled by the motor and bit 52.

After the enlarged cavity 30 has been successfully intersected by the articulated well bore 40, drilling is continued through the cavity 30 using the articulated drill string 50 and appropriate drilling apparatus to provide a subterranean well bore pattern 60 in the coal seam 16. The well bore pattern 60 and other such well bores include sloped, undulating, or other inclinations of the coal seam 16 or other subterranean zone. During this operation, gamma ray logging tools and conventional measurement while drilling devices may be employed to control and direct the orientation of the drill bit 52 to retain the well bore pattern 60 within the confines of the coal seam 16 and to provide substantially uniform coverage of a desired area within the coal seam 16.

During the process of drilling the well bore pattern 60, drilling fluid or "mud" is pumped down the articulated drill string 50 and circulated out of the drill string 50 in the vicinity of the bit 52, where it is used to scour the formation and to remove formation cuttings. The cuttings are then entrained in the drilling fluid which circulates up through the annulus between the drill string 50 and the walls of the articulated well bore 40 until it reaches the surface 14, where the cuttings are removed from the drilling fluid and the fluid is then recirculated. This conventional drilling operation produces a standard column of drilling fluid having a vertical height equal to the depth of the articulated well bore 40 and produces a hydrostatic pressure on the well bore corresponding to the well bore depth. Because coal seams tend to be porous and fractured, they may be unable to sustain such hydrostatic pressure, even if formation water is also present in the coal seam 16. Accordingly, if the full hydrostatic pressure is allowed to act on the coal seam 16, the result may be loss of drilling fluid and entrained cuttings into the formation. Such a circumstance is referred to as an "over-balanced" drilling operation in which the hydrostatic fluid pressure in the well bore exceeds the ability of the formation to withstand the pressure. Loss of drilling fluids and cuttings into the formation not only is expensive in terms of the lost drilling fluids, which must be made up, but it also tends to plug the pores in the coal seam 16, which are needed to drain the coal seam of gas and water.

To prevent over-balance drilling conditions during formation of the well bore pattern 60, air compressors 62 are provided to circulate compressed air down the well bore 12 and back up through the articulated well bore 40. The circulated air will admix with the drilling fluids in the annulus around the articulated drill string 50 and create bubbles throughout the column of drilling fluid. This has the effect of lightening the hydrostatic pressure of the drilling fluid and reducing the down-hole pressure sufficiently that drilling conditions do not become over-balanced. Aeration of the drilling fluid reduces down-hole pressure to approximately 150–200 pounds per square inch (psi). Accordingly, low pressure coal seams and other subterranean zones can be drilled without substantial loss of drilling fluid and contamination of the zone by the drilling fluid.

Foam, which may be compressed air mixed with water, may also be circulated down through the articulated drill string 50 along with the drilling mud in order to aerate the drilling fluid in the annulus as the articulated well bore 40 is being drilled and, if desired, as the well bore pattern 60 is being drilled. Drilling of the well bore pattern 60 with the use of an air hammer bit or an air-powered down-hole motor will also supply compressed air or foam to the drilling fluid. In this case, the compressed air or foam which is used to power the down-hole motor and bit 52 exits the articulated drill string 50 in the vicinity of the drill bit 52. However, the larger volume of air which can be circulated down the well bore 12 permits greater aeration of the drilling fluid than generally is possible by air supplied through the articulated drill string 50.

Figure 2:
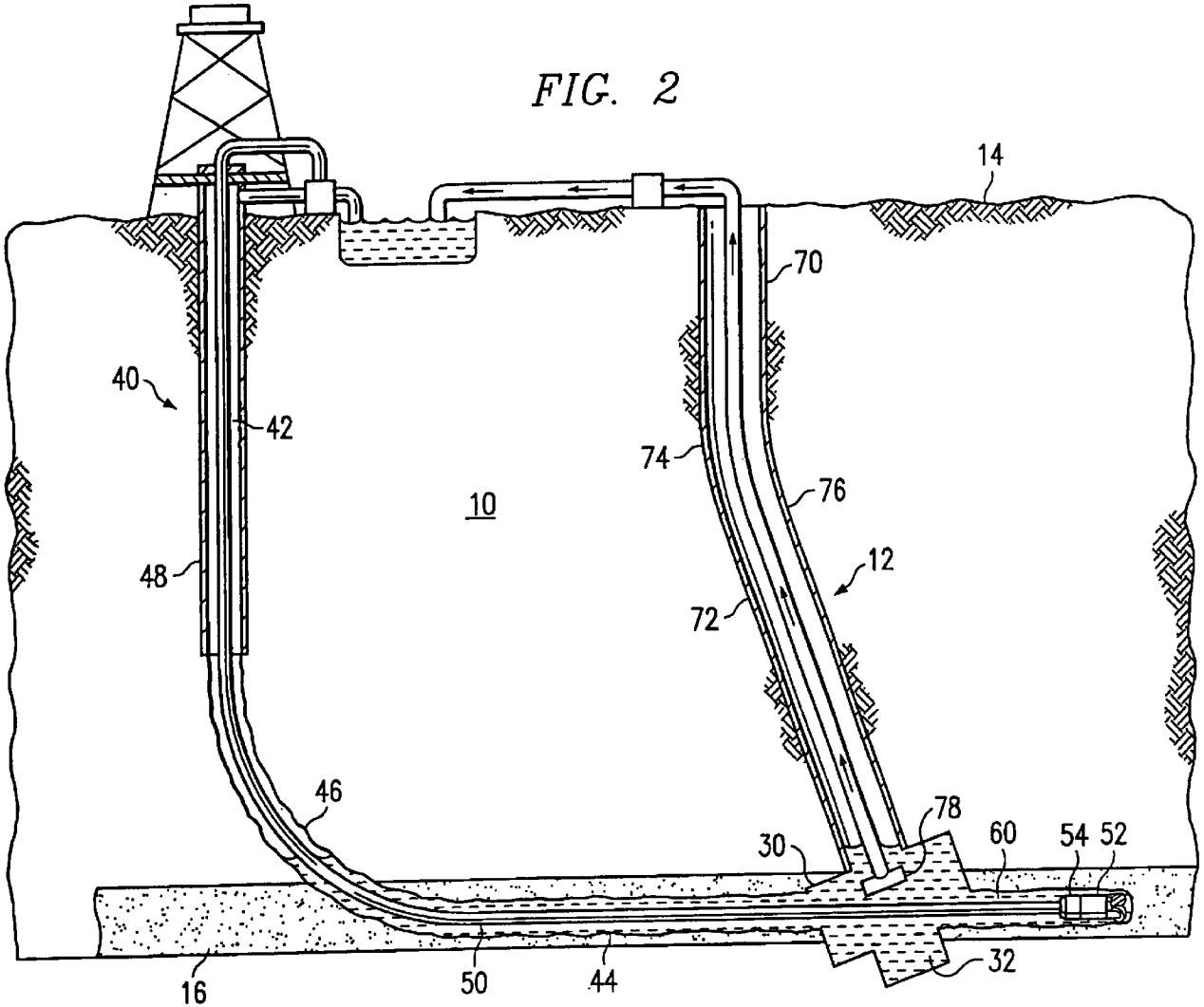
FIG. 2 is a cross-sectional diagram illustrating a system for accessing a subterranean zone from a limited surface area in accordance with another embodiment of the present invention.

FIG. 2 is a diagram illustrating system 10 for accessing a subterranean zone from a limited surface area in accordance with another embodiment of the present invention. In this embodiment, the articulated well bore 40 is formed as previously described in connection with FIG. 1. The well bore 12, in this embodiment, includes a portion 70 and an angled portion 72 disposed between the surface 14 and the coal seam 16. The portion 70 extends downwardly from the surface 14 a predetermined distance to accommodate formation of a radiused portion 74 and angled portion 72 to intersect the coal seam 16 at a desired location. In this embodiment, portion 70 is illustrated substantially vertical; however, it should be understood that portion 70 may be formed at other suitable orientations to accommodate surface 14 and/or coal seam 16 characteristics. Angled portion 72 extends from an end of the portion 70 and extends downwardly at a predetermined angle relative to portion 70 to accommodate intersection of the coal seam 16 at the desired location. Angled portion 72 may be formed having a generally uniform or straight directional configuration or may include various undulations or radiused portions as required to intersect the coal seam 16 at a desired location and/or to accommodate various subterranean obstacles, drilling requirements or characteristics.

In one embodiment, to intersect a coal seam 16 located at a depth of approximately 1200 feet below the surface 14, the portion 70 may be drilled to a depth of approximately 300 feet. Radiused portion 74 may be formed having a radius of approximately 400 feet, and angled portion 72 may be tangentially formed in communication with the radiused portion 74 at an angle relative to the portion 70 to accommodate approximately a 300 foot offset between the portion 70 and the intersection of the angled portion 72 at the target coal seam 16. However, other suitable drilling depths, drilling radii, angular orientations, and offset distances may be used to form well bore 12. The well bore 12 may also be lined with a suitable well casing 76 that terminates at or above the upper level of the coal seam 16.

The well bore 12 is logged either during or after drilling in order to locate the exact depth of the coal seam 16. As a result, the coal seam 16 is not missed in subsequent drilling operations, and techniques used to locate the coal seam 16 while drilling need not be employed. The enlarged cavity 30 is formed in the well bore 12 at the level of the coal seam 16 as previously described in connection with FIG. 1. However, as illustrated in FIG. 2, because of the angled portion 72 of the well bore 12, the enlarged cavity 30 may be disposed at an angle relative to the coal seam 16. As described above, the enlarged cavity 30 provides a junction for intersection of the well bore 12 and the articulated well bore 40 to provide a collection point for fluids drained from the coal seam 16 during production operations. Thus, depending on the angular orientation of the angled portion 72, the radius and/or vertical dimension of the enlarged cavity 30 may be modified such that portions of the enlarged cavity 30 equal or exceed the vertical dimension of the coal seam 16. Angled portion 72 of the well bore 12 continues below the enlarged cavity 30 to form a sump 32 for the cavity 30.

After intersection of the enlarged cavity 30 by the articulated well bore 40, a pumping unit 78 is installed in the enlarged cavity 30 to pump drilling fluid and cuttings to the surface 14 through the well bore 12. This eliminates the friction of air and fluid returning up the articulated well bore 40 and reduces down-hole pressure to nearly zero. Pumping unit 78 may include a sucker rod pump, a submersible pump, a progressing cavity pump, or other suitable pumping device for removing drilling fluid and cuttings to the surface 14. Accordingly, coal seams and other subterranean zones having ultra low pressures, such as below 150 psi, can be accessed from the surface. Additionally, the risk of combining air and methane in the well is substantially eliminated.

Figure 3:
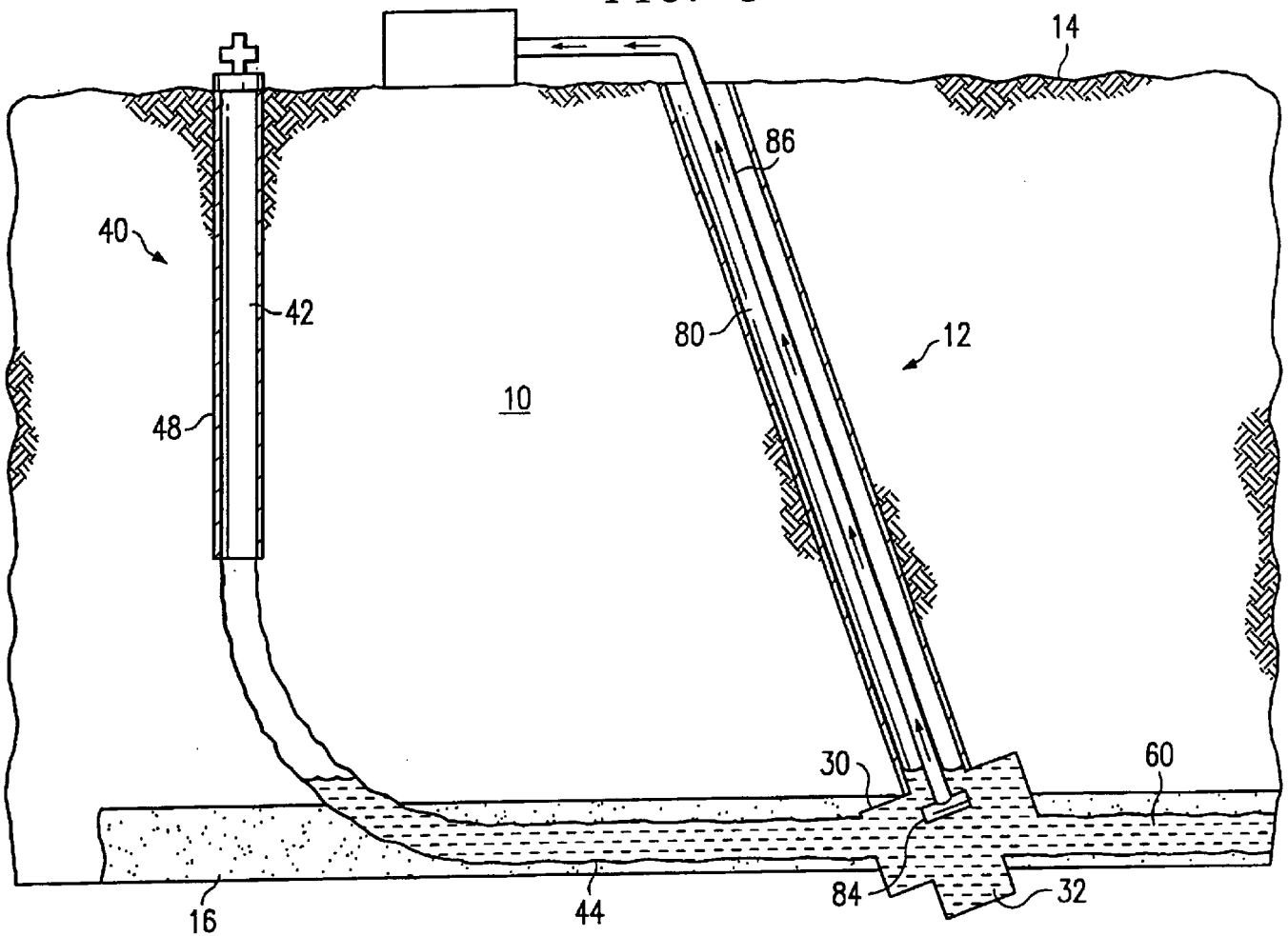
FIG. 3 is a cross-sectional diagram illustrating a system for accessing a subterranean zone from a limited surface area in accordance with another embodiment of the present invention.

FIG. 3 is a diagram illustrating system 10 for accessing a subterranean zone from a limited surface area in accordance with another embodiment of the present invention. In this embodiment, the articulated well bore 40 is formed as previously described in connection with FIG. 1. The well bore 12, in this embodiment, includes an angled portion 80 disposed between the surface 14 and the coal seam 16. For example, in this embodiment, the angled portion 80 extends downwardly from the surface 14 at a predetermined angular orientation to intersect the coal seam 16 at a desired location. Angled portion 80 may be formed having a generally uniform or straight directional configuration or may include various undulations or radiused portions as required to intersect the coal seam 16 at a desired location and/or to accommodate various subterranean obstacles, drilling requirements or characteristics.

In one embodiment, to intersect a coal seam 16 located at a depth of approximately 1200 feet below the surface 14, the angled portion 80 may be drilled at an angle of approximately 20 degrees from vertical to accommodate approximately a 440 foot offset between the surface 14 location of the angled portion 80 and the intersection of the angled portion 80 at the target coal seam 16. However, other suitable angular orientations and offset distances may be used to form angled portion 80 of well bore 12. The well bore 12 may also be lined with a suitable well casing 82 that terminates at or above the upper level of the coal seam 16.

The well bore 12 is logged either during or after drilling in order to locate the exact depth of the coal seam 16. As a result, the coal seam 16 is not missed in subsequent drilling operations, and techniques used to locate the coal seam 16 while drilling need not be employed. The enlarged cavity 30 is formed in the well bore 12 at the level of the coal seam 16 as previously described in connection with FIG. 1. However, as illustrated in FIG. 2, because of the angled portion 80 of the well bore 12, the enlarged cavity 30 may be disposed at an angle relative to the coal seam 16. As described above, the enlarged cavity 30 provides a junction for intersection of the well bore 12 and the articulated well bore 40 to provide a collection point for fluids drained from the coal seam 16 during production operations. Thus, depending on the angular orientation of the angled portion 80, the radius and/or vertical dimension of the enlarged cavity 30 may be modified such that portions of the enlarged cavity 30 equal or exceed the vertical dimension of the coal seam 16. Angled portion 80 of the well bore 12 continues below the enlarged cavity 30 to form a sump 32 for the cavity 30.

After the well bore 12, articulated well bore 40, enlarged cavity 30 and the desired well bore pattern 60 have been formed, the articulated drill string 50 is removed from the articulated well bore 40 and the articulated well bore 40 is capped. A down hole production or pumping unit 84 is disposed in the well bore 12 in the enlarged cavity 30. The enlarged cavity 30 provides a reservoir for accumulated fluids allowing intermittent pumping without adverse effects of a hydrostatic head caused by accumulated fluids in the well bore. Pumping unit 84 may include a sucker rod pump, a submersible pump, a progressing cavity pump, or other suitable pumping device for removing accumulated fluids to the surface.

The down hole pumping unit 84 is connected to the surface 14 via a tubing string 86. The down hole pumping unit 84 is used to remove water and entrained coal fines from the coal seam 16 via the well bore pattern 60. Once the water is removed to the surface 14, it may be treated for separation of methane which may be dissolved in the water and for removal of entrained fines. After sufficient water has been removed from the coal seam 16, pure coal seam gas may be allowed to flow to the surface 14 through the annulus of the well bore 12 around the tubing string 86 and removed via piping attached to a wellhead apparatus. At the surface 14, the methane is treated, compressed and pumped through a pipeline for use as a fuel in a conventional manner. The down hole pumping unit 84 may be operated continuously or as needed to remove water drained from the coal seam 16 into the enlarged diameter cavity 30.

Figure 4:
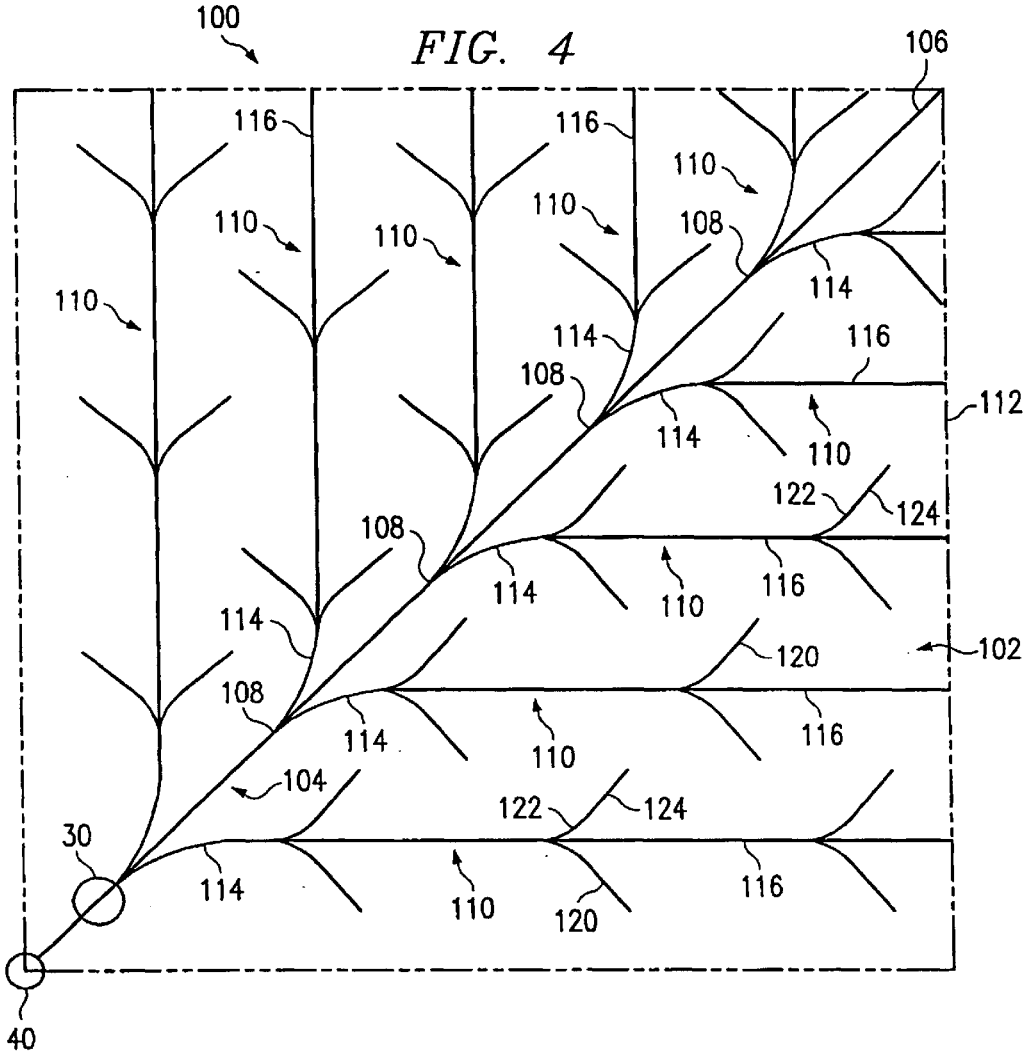
FIG. 4 is a diagram illustrating a top plan view of a pinnate well bore pattern for accessing a subterranean zone in accordance with an embodiment of the present invention.
Figure 5:
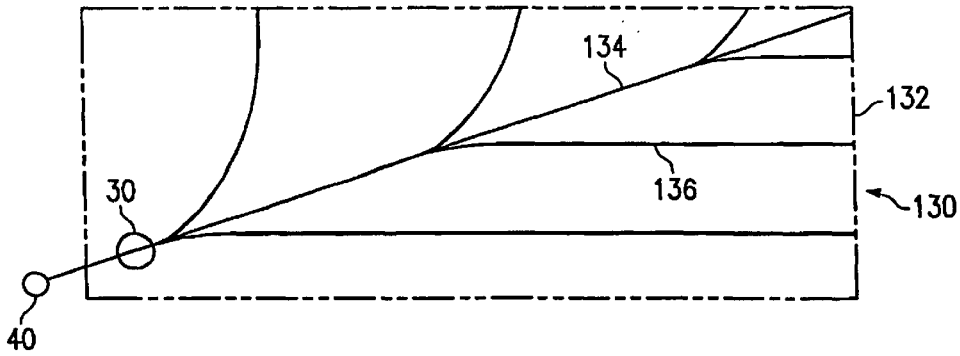
FIG. 5 is a diagram illustrating a top plan view of a pinnate well bore pattern for accessing a subterranean zone in accordance with another embodiment of the present invention.
Figure 6:
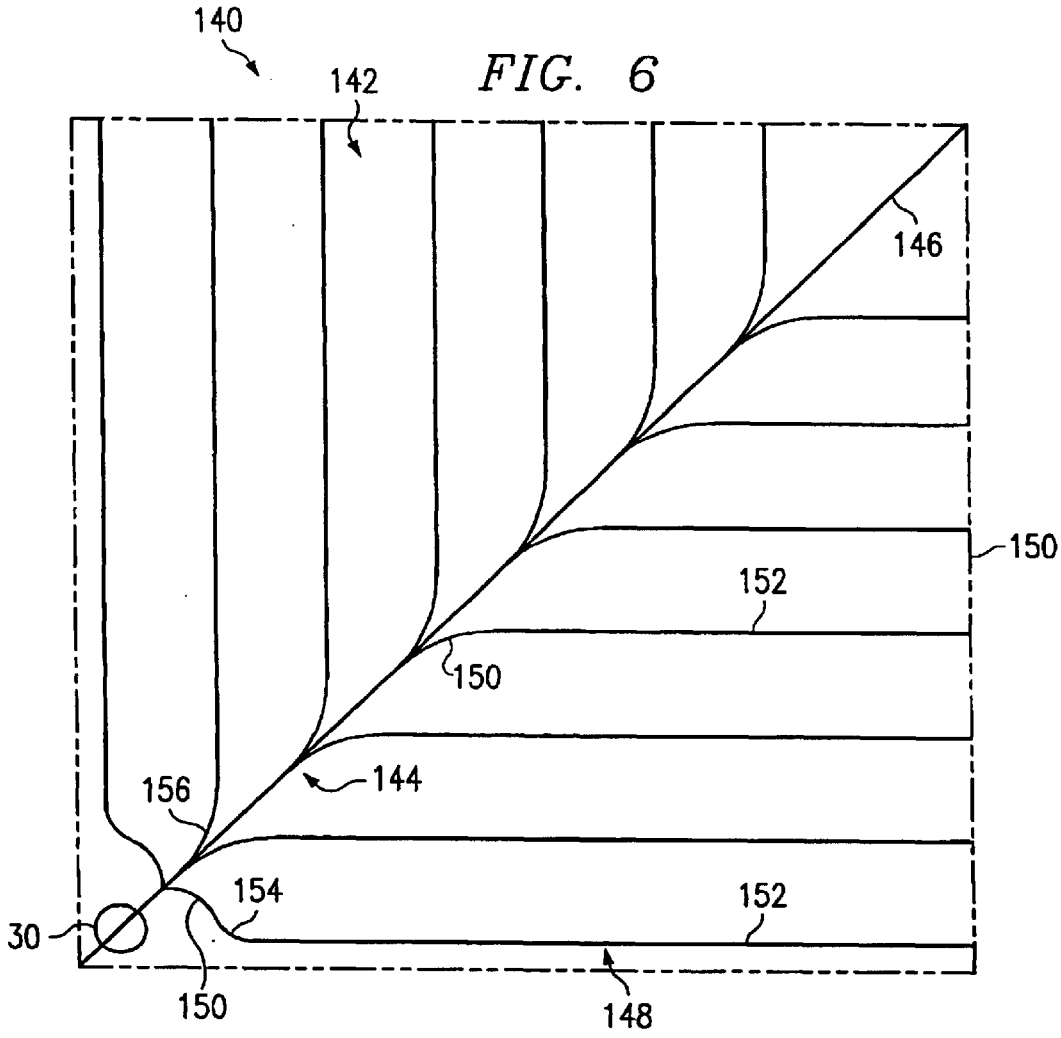
FIG. 6 is a diagram illustrating a top plan view of a pinnate well bore pattern for accessing a subterranean zone in accordance with another embodiment of the present invention.

FIGS. 4–6 are diagrams illustrating top plan views of subterranean well bore patterns 60 for accessing the coal seam 16 or other subterranean zone in accordance with embodiments of the present invention. In these embodiments, the well bore patterns 60 comprise pinnate well bore patterns that have a central or main well bore with generally symmetrically arranged and appropriately spaced lateral well bores extending from each side of the main well bore. The pinnate well bore pattern approximates the pattern of veins in a leaf or the design of a feather in that it has similar, substantially parallel, auxiliary well bores arranged in substantially equal and parallel spacing on opposite sides of an axis. The pinnate well bore pattern with its central bore and generally symmetrically arranged and appropriately spaced auxiliary well bores on each side provides a uniform pattern for accessing a subterranean formation. As described in more detail below, the pinnate well bore pattern provides substantially uniform coverage of a square, other quadrilateral, or grid area and may be aligned with longwall mining panels for preparing the coal seam 16 for mining operations. A plurality of well bore patterns may also be nested adjacent each other to provide uniform coverage of a subterranean region. It will be understood that other suitable well bore patterns may be used in accordance with the present invention.

The pinnate and other suitable well bore patterns 60 drilled from the surface 14 provide surface access to subterranean formations. The well bore pattern 60 may be used to uniformly remove and/or insert fluids or otherwise manipulate a subterranean deposit. In non-coal applications, the well bore pattern 60 may be used initiating in-situ burns, "huff-puff" steam operations for heavy crude oil, and the removal of hydrocarbons from low porosity reservoirs.

FIG. 4 is a diagram illustrating a pinnate well bore pattern 100 in accordance with one embodiment of the present invention. In this embodiment, the pinnate well bore pattern 100 provides access to a substantially square area 102 of a subterranean zone. A number of the pinnate patterns 100 may be used together to provide uniform access to a large subterranean region.

Referring to FIG. 4, the enlarged cavity 30 defines a first corner of the area 102. The pinnate well bore pattern 100 includes a main well bore 104 extending diagonally across the area 102 to a distant corner 106 of the area 102. Preferably, the well bore 12 and articulated well bore 40 are positioned over the area 102 such that the well bore 104 is drilled up the slope of the coal seam 16. This will facilitate collection of water, gas, and other fluids from the area 102. The well bore 104 is drilled using the articulated drill string 50 and extends from the enlarged cavity 30 in alignment with the articulated well bore 40.

A set of lateral well bores 110 extend from opposites sides of well bore 104 to a periphery 112 of the area 102. The lateral well bores 110 may mirror each other on opposite sides of the well bore 104 or may be offset from each other along the well bore 104. Each of the lateral well bores 110 includes a radius curving portion 114 extending from the well bore 104 and an elongated portion 116 formed after the curved portion 114 has reached a desired orientation. For uniform coverage of the square area 102, pairs of lateral well bores 110 are substantially evenly spaced on each side of the well bore 104 and extend from the well bore 104 at an angle of approximately 45 degrees. However, the lateral well bores 110 may be form at other suitable angular orientations relative to well bore 104. The lateral well bores 110 shorten in length based on progression away from the enlarged diameter cavity 30 in order to facilitate drilling of the lateral well bores 110. Additionally, as illustrated in FIG. 4, a distance to the periphery 112 of the area 102 to cavity 30 or well bores 30 or 40 measured along the lateral well bores 110 is substantially equal for each lateral well bore 110, thereby facilitating the formation of the lateral well bores 110.

The pinnate well bore pattern 100 using a single well bore 104 and five pairs of lateral bores 110 may drain a coal seam area of approximately 150 acres in size. Where a smaller area is to be drained, or where the coal seam has a different shape, such as a long, narrow shape, or due to surface or subterranean topography, alternate pinnate well bore patterns may be employed by varying the angle of the lateral well bores 110 to the well bore 104 and the orientation of the lateral well bores 110. Alternatively, lateral well bores 110 can be drilled from only one side of the well bore 104 to form a one-half pinnate well bore pattern.

The well bore 104 and the lateral well bores 110 are formed by drilling through the enlarged cavity 30 using the articulated drill string 50 and an appropriate drilling apparatus. During this operation, gamma ray logging tools and conventional measurement while drilling (MWD) technologies may be employed to control the direction and orientation of the drill bit so as to retain the well bore pattern 100 within the confines of the coal seam 16 and to maintain proper spacing and orientation of the well bore 104 and lateral well bores 110.

In a particular embodiment, the well bore 104 is drilled with an incline at each of a plurality of lateral kick-off points 108. After the well bore 104 is complete, the articulated drill string 50 is backed up to each successive lateral point 108 from which a lateral well bore 110 is drilled on each side of the well bore 104. It will be understood that the pinnate well bore pattern 100 may be otherwise suitably formed in accordance with the present invention.

In the embodiment illustrated in FIG. 4, well bore pattern 100 also includes a set of lateral well bores 120 extending from lateral well bores 110. The lateral well bores 120 may mirror each other on opposite sides of the lateral well bore 110 or may be offset from each other along the lateral well bore 110. Each of the lateral well bores 120 includes a radius curving portion 122 extending from the lateral well bore 110 and an elongated portion 124 formed after the curved portion 122 has reached a desired orientation. For uniform coverage of the area 102, pairs of lateral well bores 120 may be disposed substantially equally spaced on each side of the lateral well bore 110. Additionally, lateral well bores 120 extending from one lateral well bore 110 may be disposed to extend between lateral well bores 120 extending from an adjacent lateral well bore 110 to provide uniform coverage of the area 102. However, the quantity, spacing, and angular orientation of lateral well bores 120 may be varied to accommodate a variety of resource areas, sizes and drainage requirements.

FIG. 5 illustrates a pinnate well bore pattern 130 in accordance with another embodiment of the present invention. In this embodiment, the pinnate well bore pattern 130 provides access to a substantially rectangular area 132. The pinnate well bore pattern 130 includes a well bore 124 extending substantially diagonally from each corner of the area 132 and a plurality of lateral well bores 136 that are formed as described in connection with well bore 104 and lateral bores 110 of FIG. 4. For the substantially rectangular area 132, however, the lateral well bores 136 on a first side of the well bore 134 include a shallow angle while the lateral well bores 136 on the opposite side of the well bore 134 include a steeper angle to together provide uniform coverage of the area 132.

FIG. 6 illustrates a pinnate well bore pattern 140 in accordance with another embodiment of the present invention. In this embodiment, the enlarged cavity 30 defines a first corner of an area 142 of the zone. The pinnate well bore pattern 140 includes a well bore 144 extending diagonally across the area 142 to a distant corner 146 of the area 142. Preferably, the well bore 12 and the articulated well bore 40 are positioned over the area 142 such that the well bore 144 is drilled up the slope of the coal seam 16. This will facilitate collection of water, gas, and other fluids from the area 142. The well bore 144 is drilled using the articulated drill string 50 and extends from the enlarged cavity 30 in alignment with the articulated well bore 40.

A plurality of lateral well bores 148 extend from the opposites sides of well bore 144 to a periphery 150 of the area 142 as described above in connection with well bores 104 and 110 of FIG. 4. The lateral well bores 148 may mirror each other on opposite sides of the well bore 144 or may be offset from each other along the well bore 144. Each of the lateral well bores 148 includes a radius curving portion 150 extending from the well bore 144 and an elongated portion 152 extending from the radius curving portion 150. The elongated portion 152 is formed after the curving portion 150 has reached a desired orientation. The first set of lateral well bores 148 located proximate to the cavity 30 may also include a radius curving portion 154 formed after the curving portion 150 has reached a desired orientation. In this set, the elongated portion 152 is formed after the curving portion 154 has reached a desired orientation. Thus, the first set of lateral well bores 148 kicks or turns back towards the enlarged cavity 30 before extending outward through the formation, thereby extending the drainage area back towards the cavity 30 to provide uniform coverage of the area 142. For uniform coverage of the area 142, pairs of lateral well bores 148 are substantially evenly spaced on each side of the well bore 144 and extend from the well bore 144 at an angle of approximately 45 degrees. However, lateral well bores 148 may be formed at other angular orientations relative to the well bore 144. The lateral well bores 148 shorten in length based on progression away from the enlarged cavity 30 in order to facilitate drilling of the lateral well bores 148. Additionally, as illustrated in FIG. 6, a distance to the periphery 150 of the area 142 from the cavity 30 measured along each lateral well bore 148 is substantially equal for each lateral well bore 148, thereby facilitating the formation of lateral well bores 148.

The well bore 144 and the lateral well bores 148 are formed by drilling through the enlarged cavity 30 using the articulated drill string 50 and an appropriate drilling apparatus. During this operation, gamma ray logging tools and conventional measurement while drilling (MWD) technologies may be employed to control the direction and orientation of the drill bit so as to retain the well bore pattern 140 within the confines of the coal seam 16 and to maintain proper spacing and orientation of the well bore 144 and lateral well bores 148. In a particular embodiment, the well bore 144 is drilled with an incline at each of a plurality of lateral kick-off points 156. After the well bore 144 is complete, the articulated drill string 50 is backed up to each successive lateral point 156 from which a lateral well bore 148 is drilled on each side of the well bore 144. It should be understood that the pinnate well bore pattern 140 may be otherwise suitably formed in accordance with the present invention.

Figure 7:
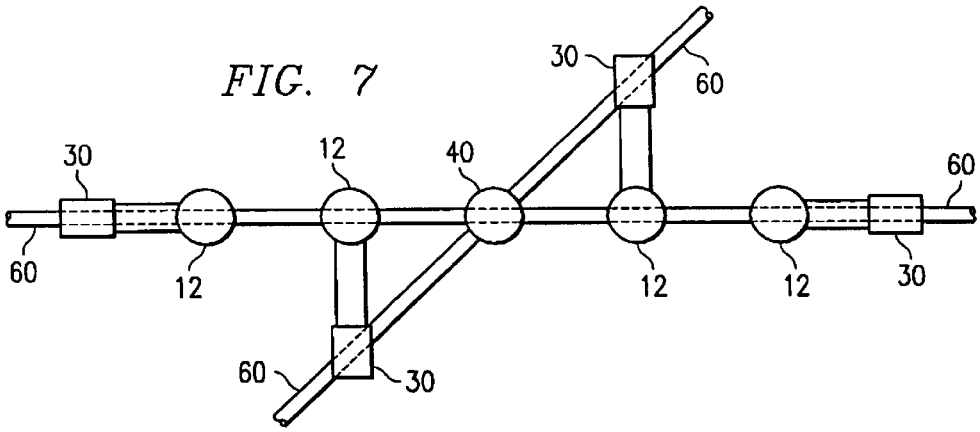
FIG. 7 is a diagram illustrating a top plan view of multiple well bore patterns in a subterranean zone through an articulated surface well intersecting multiple surface cavity wells in accordance with an embodiment of the present invention.

FIG. 7 is a diagram illustrating multiple well bore patterns in a subterranean zone through an articulated well bore 40 intersecting multiple well bores 12 in accordance with an embodiment of the present invention. In this embodiment, four well bores 12 are used to access a subterranean zone through well bore patterns 60. However, it should be understood that a varying number of well bores 12 and well bore patterns 60 may be used depending on the geometry of the underlying subterranean formation, desired access area, production requirements, and other factors.

Referring to FIG. 7, four well bores 12 are formed disposed in a spaced apart and substantially linear formation relative to each other at the surface 14. Additionally, the articulated well bore 40, in this embodiment, is disposed linearly with the well bores 12 having a pair of well bores 12 disposed on each side of the surface location of the articulated well bore 40. Thus, the well bores 12 and the articulated well bore 40 may be located over a subterranean resource in close proximity to each other and in a suitable formation to minimize the surface area required for accessing the subterranean formation. For example, according to one embodiment, each of the well bores 12 and the articulated well bore 40 may be spaced apart from each other at the surface 14 in a linear formation by approximately twenty-five feet, thereby substantially reducing the surface area required to access the subterranean resource. As a result, the well bores 12 and articulated well bore 40 may be formed on or adjacent to a roadway, steep hillside, or other limited surface area. Accordingly, environmental impact is minimized as less surface area must be cleared. Well bores 12 and 40 may also be disposed in a substantially nonlinear formation in close proximity to each other as described above to minimize the surface area required for accessing the subterranean formation.

As described above, well bores 12 are formed extending downwardly from the surface and may be configured as illustrated in FIGS. 1–3 to accommodate a desired offset distance between the surface location of each well bore 12 and the intersection of the well bore 12 with the coal seam 16 or other subterranean formation. Enlarged cavities 30 are formed proximate the coal seam 16 in each of the well bores 12, and the articulated well bore 40 is formed intersecting each of the enlarged cavities 30. In the embodiment illustrated in FIG. 7, the bottom hole location or intersection of each of the well bores 12 with the coal seam 16 is located either linearly or at a substantially ninety degree angle to the linear formation of the well bores 12 at the surface. However, the location and angular orientation of the intersection of the well bores 12 with the coal seam 16 relative to the linear formation of the well bores 12 at the surface 14 may be varied to accommodate a desired access formation or subterranean resource configuration.

Well bore patterns 60 are drilled within the target subterranean zone from the articulated well bore 40 extending from each of the enlarged cavities 30. In resource removal applications, resources from the target subterranean zone drain into each of the well bore patterns 60, where the resources are collected in the enlarged cavities 30. Once the resources have been collected in the enlarged cavities 30, the resources may be removed to the surface through the well bores 12 by the methods described above.

Figure 8:
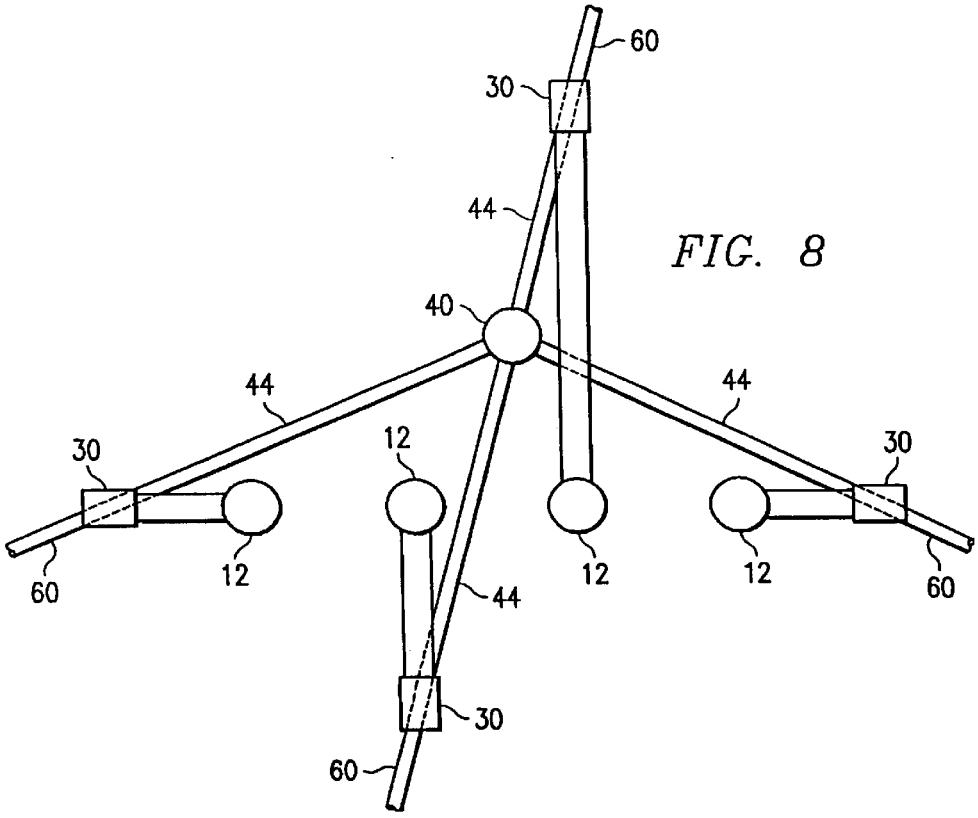
FIG. 8 is a diagram illustrating a top plan view of multiple well bore patterns in a subterranean zone through an articulated surface well intersecting multiple cavity wells in accordance with another embodiment of the present invention.

FIG. 8 is a diagram illustrating multiple horizontal well bore patterns in a subterranean zone through an articulated well bore 40 intersecting multiple well bores 12 in accordance with another embodiment of the present invention. In this embodiment, four well bores 12 are used to collect and remove to the surface 14 resources collected from well bore patterns 60. However, it should be understood that a varying number of well bores 12 and well bore patterns 60 may be used depending on the geometry of the underlying subterranean formation, desired access area, production requirements, and other factors.

Referring to FIG. 8, four well bores 12 are formed disposed in a spaced apart and substantially linear formation relative to each other at the surface 14. In this embodiment, the articulated well bore 40 is offset from and disposed adjacent to the linear formation of the well bores 12. As illustrated in FIG. 8, the articulated well bore 40 is located such that a pair of well bores 12 are disposed on each side of the articulated well bore 40 in a direction substantially orthogonal to the linear formation of well bores 12. Thus, the well bores 12 and the articulated well bore 40 may be located over a subterranean resource in close proximity to each other and in a suitable formation to minimize the surface area required for gas production and coal seam 16 treatment. For example, according to one embodiment, each of the well bores 12 may be spaced apart from each other at the surface 14 in a linear formation by approximately twenty-five feet, and the articulated well bore 40 may be spaced apart from each of the two medially-located well bores 12 by approximately twenty-five feet, thereby substantially reducing the surface area required to access the subterranean resource and for production and drilling. As a result, the well bores 12 and articulated well bore 40 may be formed on or adjacent to a roadway, steep hillside, or other limited surface area. Accordingly, environmental impact is minimized as less surface area must be cleared.

As described above, well bores 12 are formed extending downwardly from the surface and may be configured as illustrated in FIGS. 1–3 to accommodate a desired offset distance between the surface location of each well bore 12 and the intersection of the well bore 12 with the coal seam 16. Enlarged cavities 30 are formed proximate the coal seam 16 in each of the well bores 12, and the articulated well bore 40 is formed intersecting each of the enlarged cavities 30. In the embodiment illustrated in FIG. 8, the bottom hole location or intersection of each of the well bores 12 with the coal seam 16 is located either linearly or at a substantially ninety degree angle to the linear formation of the well bores 12 at the surface. However, the location and angular orientation of the intersection of the well bores 12 with the coal seam 16 relative to the linear formation of the well bores 12 at the surface 14 may be varied to accommodate a desired drainage formation or subterranean resource configuration.

Well bore patterns 60 are drilled within the target subterranean zone from the articulated well bore 40 extending from each of the enlarged cavities 30. In resource collection applications, resources from the target subterranean zone drain into each of the well bore patterns 60, where the resources are collected in the enlarged cavities 30. Once the resources have been collected in the enlarged cavities 30, the resources may be removed to the surface through the well bores 12 by the methods described above.

Figure 9:
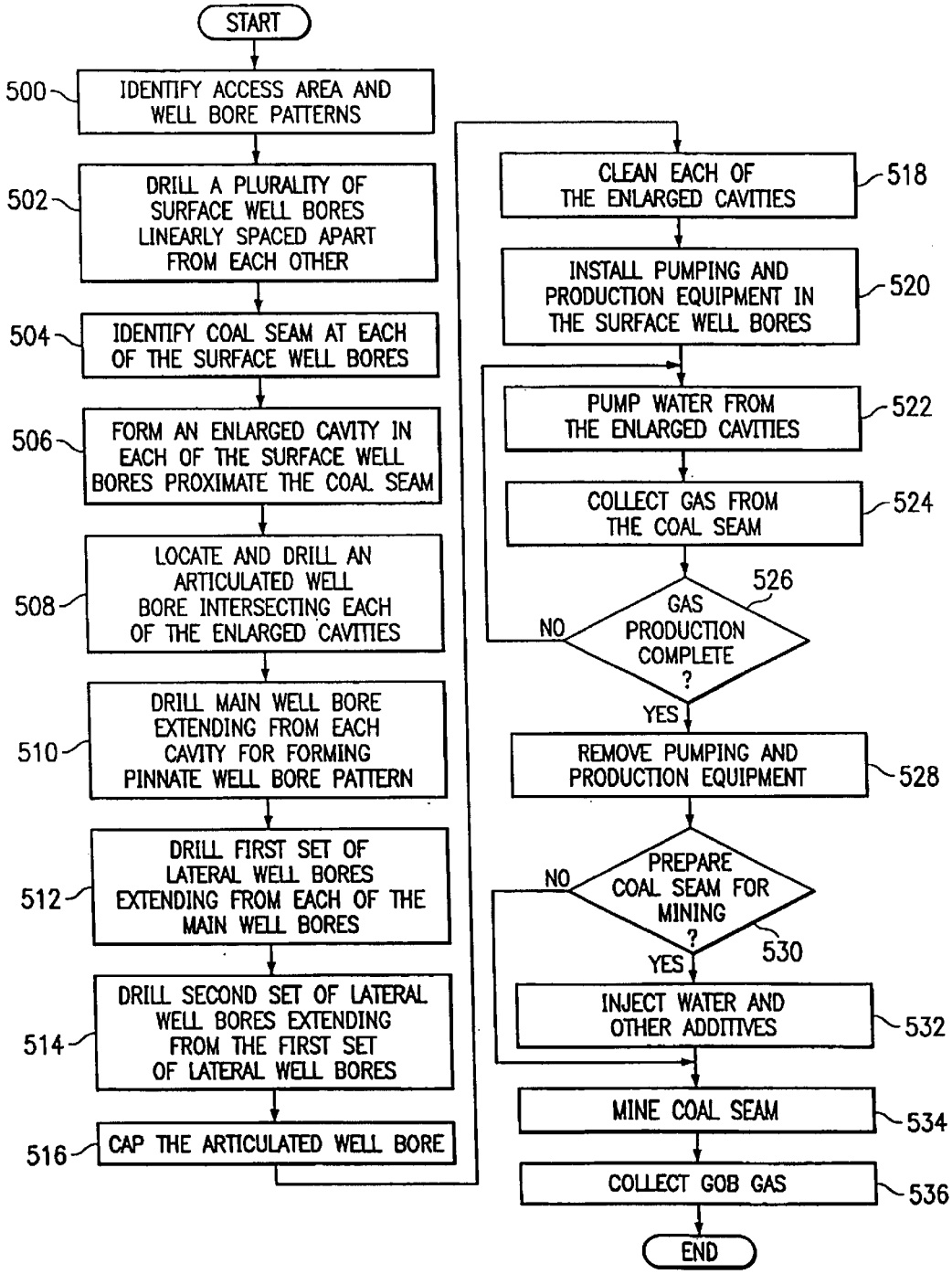
FIG. 9 is a flow diagram illustrating a method for accessing a subterranean zone from a limited surface area in accordance with an embodiment of the present invention.

FIG. 9 is a flow diagram illustrating a method for enhanced access to a subterranean resource, such as a coal seam 16, from a limited surface area in accordance with an embodiment of the present invention. In this embodiment, the method begins at step 500 in which areas to be accessed and well bore patterns for the areas are identified. Pinnate well bore patterns may be used to provide optimized coverage for the region. However, it should be understood that other suitable well bore patterns may also be used.

Proceeding to step 502, a plurality of well bores 12 are drilled from the surface 14 to a predetermined depth through the coal seam 16. The well bores 12 may be formed having a substantially linear spaced apart relationship relative to each other or may be nonlinearly disposed relative to each other while minimizing the surface area required for accessing the subterranean resource. Next, at step 504, down hole logging equipment is utilized to exactly identify the location of the coal seam 16 in each of the well bores 12. At step 506, the enlarged cavities 30 are formed in each of the well bores 12 at the location of the coal seam 16. As previously discussed, the enlarged cavities 30 may be formed by under reaming and other conventional techniques.

At step 508, the articulated well bore 40 is drilled to intersect each of the enlarged cavities 30 formed in the well bores 12. At step 510, the well bores 104 for the pinnate well bore patterns are drilled through the articulated well bore 40 into the coal seam 16 extending from each of the enlarged cavities 30. After formation of the well bores 104, lateral well bores 110 for the pinnate well bore pattern are drilled at step 512. Lateral well bores 148 for the pinnate well bore pattern are formed at step 514.

At step 516, the articulated well bore 40 is capped. Next, at step 518, the enlarged cavities 30 are cleaned in preparation for installation of downhole production equipment. The enlarged cavities 30 may be cleaned by pumping compressed air down the well bores 12 or other suitable techniques. At step 520, production equipment is installed in the well bores 12. The production equipment may include pumping units and associated equipment extending down into the cavities 30 for removing water from the coal seam 16. The removal of water will drop the pressure of the coal seam and allow methane gas to diffuse and be produced up the annulus of the well bores 12.

Proceeding to step 522, water that drains from the well bore patterns into the cavities 30 is pumped to the surface 14. Water may be continuously or intermittently pumped as needed to remove it from the cavities 30. At step 524, methane gas diffused from the coal seam 16 is continuously collected at the surface 14. Next, at decisional step 526, it is determined whether the production of gas from the coal seam 16 is complete. The production of gas may be complete after the cost of the collecting the gas exceeds the revenue generated by the well. Or, gas may continue to be produced from the well until a remaining level of gas in the coal seam 16 is below required levels for mining operations. If production of the gas is not complete, the method returns to steps 522 and 524 in which water and gas continue to be removed from the coal seam 16. Upon completion of production, the method proceeds from step 526 to step 528 where the production equipment is removed.

Next, at decisional step 530, it is determined whether the coal seam 16 is to be further prepared for mining operations. If the coal seam 16 is to be further prepared for mining operations, the method proceeds to step 532, where water and other additives may be injected back into the coal seam 16 to rehydrate the coal seam 16 in order to minimize dust, improve the efficiency of mining, and improve the mined product.

If additional preparation of the coal seam 16 for mining is not required, the method proceeds from step 530 to step 534, where the coal seam 16 is mined. The removal of the coal from the coal seam 16 causes the mined roof to cave and fracture into the opening behind the mining process. The collapsed roof creates gob gas which may be collected at step 536 through the well bores 12. Accordingly, additional drilling operations are not required to recover gob gas from a mined coal seam 16. Step 536 leads to the end of the process by which a coal seam 16 is efficiently degasified from the surface. The method provides a symbiotic relationship with the mine to remove unwanted gas prior to mining and to rehydrate the coal prior to the mining process.

Thus, the present invention provides greater access to subterranean resources from a limited surface area than prior systems and methods by providing decreasing the surface area required for dual well systems. For example, a plurality of well bores 12 may be disposed in close proximity to each other, for example, in a linearly or nonlinearly spaced apart relationship to each other, such that the well bores 12 may be located along a roadside or other generally small surface area. Additionally, the well bores 12 may include angled portions 20, 72 or 80 to accommodate formation of the articulated well bore 40 in close proximity to the well bores 12 while providing an offset to the intersection of the articulated well bore 40 with the well bores 12.

Figure 10:
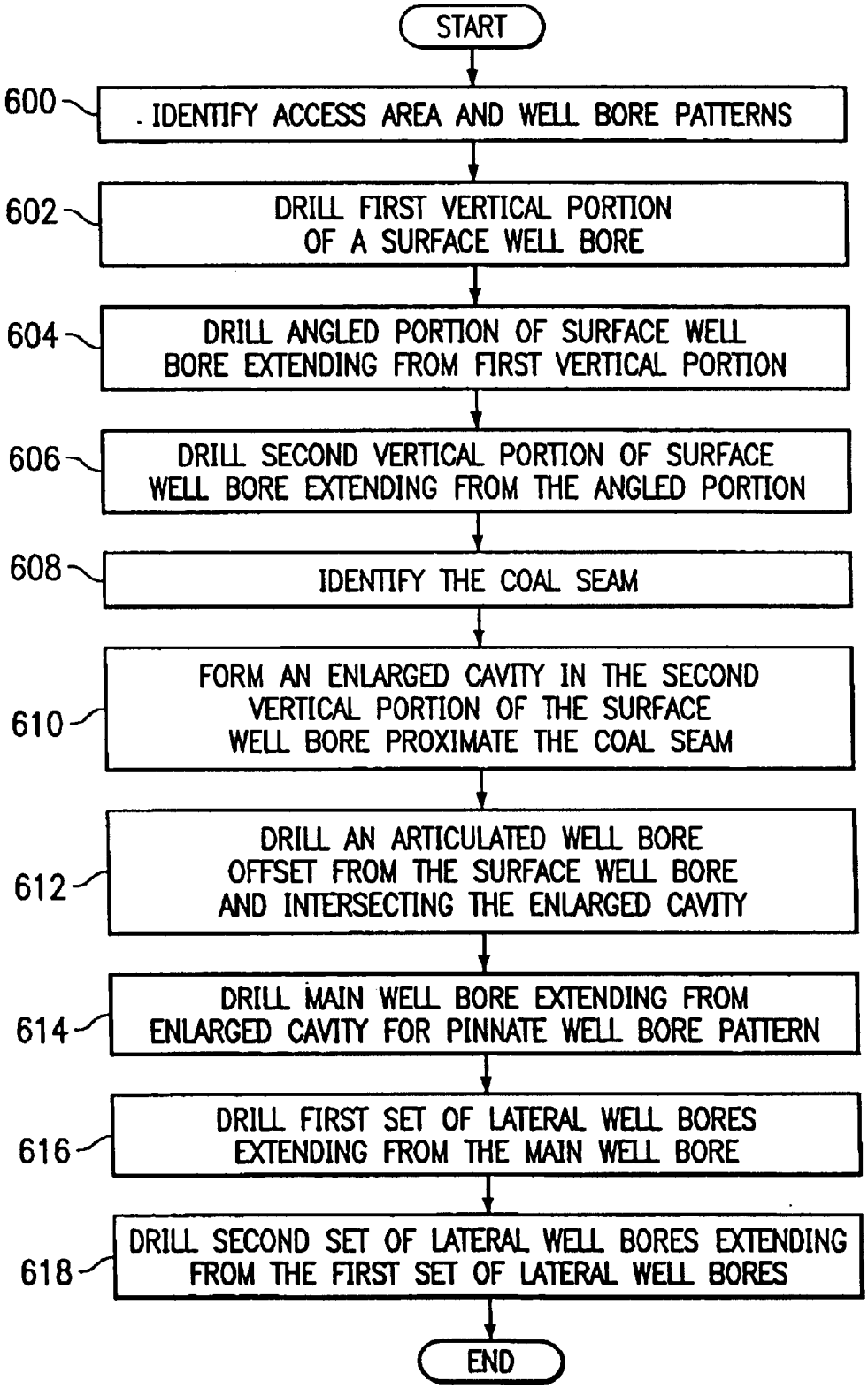
FIG. 10 is a flow diagram illustrating a method for accessing a subterranean zone from a limited surface area in accordance with another embodiment of the present invention.

FIG. 10 is a flow diagram illustrating a method for enhanced access to a subterranean resource, such as a coal seam 16, from a limited surface area in accordance with an embodiment of the present invention. In this embodiment, the method begins at step 600 in which areas to be accessed and well bore patterns for the areas are identified. Pinnate well bore patterns may be used to provide optimized coverage for the region. However, it should be understood that other suitable well bore patterns may also be used.

Proceeding to step 602, the portion 18 of the well bore 12 is formed to a predetermined depth. As described above in connection with FIG. 1, the depth of the portion 18 may vary depending on the location and desired offset distance between the intersection of the well bore 12 with the coal seam 16 and the surface location of the well bore 12. The angled portion 20 of the well bore 12 is formed at step 604 extending from the portion 18, and the portion 22 of the well bore 12 is formed at step 606 extending from the angled portion 20. As described above in connection with FIG. 1, the angular orientation of the angled portion 20 and the depth of the intersection of the angled portion 20 with the portion 22 may vary to accommodate a desired intersection location of the coal seam 16 by the well bore 12.

Next, at step 608, down hole logging equipment is utilized to exactly identify the location of the coal seam 16 in the well bore 12. At step 610, the enlarged cavity 30 is formed in the portion 22 of the well bore 12 at the location of the coal seam 16. As previously discussed, the enlarged cavity 30 may be formed by under reaming and other conventional techniques.

At step 612, the articulated well bore 40 is drilled to intersect the enlarged cavity 30 formed in the portion 22 of the well bore 12. At step 614, the well bore 104 for the pinnate well bore pattern is drilled through the articulated well bore 40 into the coal seam 16 extending from the enlarged cavity 30. After formation of the well bore 104, lateral well bores 110 for the pinnate well bore pattern are drilled at step 616. Lateral well bores 148 for the pinnate well bore pattern are formed at step 618.

Figure 11:
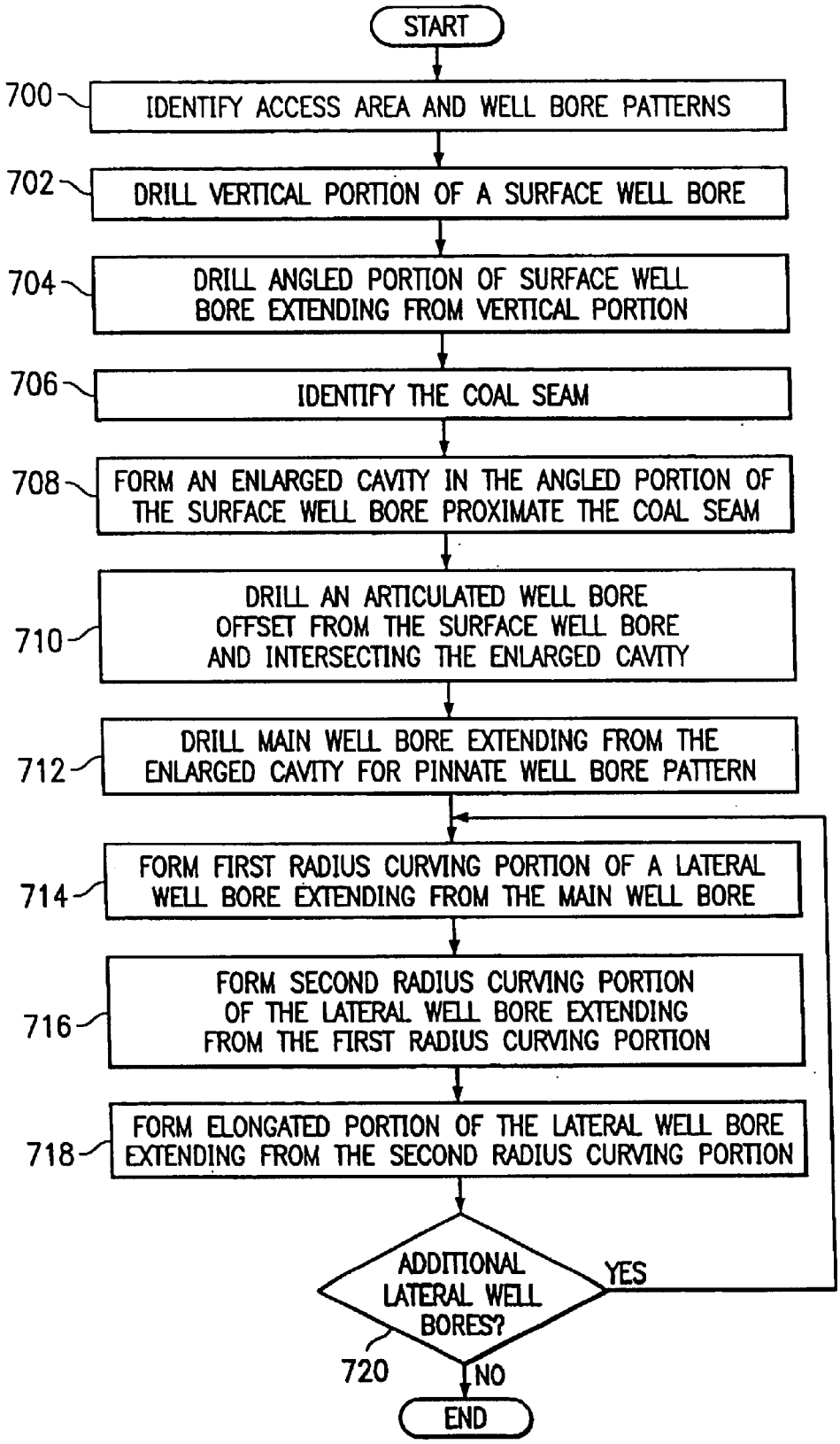
FIG. 11 is a flow diagram illustrating a method for accessing a subterranean zone from a limited surface area in accordance with another embodiment of the present invention.

FIG. 11 is a flow diagram illustrating a method for enhanced access to a subterranean resource, such as a coal seam 16, from a limited surface area in accordance with an embodiment of the present invention. In this embodiment, the method begins at step 700 in which areas to be accessed and well bore patterns for the areas are identified. Pinnate well bore patterns may be used to provide optimized coverage for the region. However, it should be understood that other suitable well bore patterns may also be used.

Proceeding to step 702, the portion 70 of the well bore 12 is formed to a predetermined depth. As described above in connection with FIG. 2, the depth of the portion 70 may vary depending on the location and desired offset distance between the intersection of the well bore 12 with the coal seam 16 and the surface location of the well bore 12. The angled portion 72 of the well bore 12 is formed at step 704 extending downwardly from the portion 70. As described above in connection with FIG. 2, the angular orientation of the angled portion 72 may vary to accommodate a desired intersection location of the coal seam 16 by the well bore 12.

Next, at step 706, down hole logging equipment is utilized to exactly identify the location of the coal seam 16 in the well bore 12. At step 708, the enlarged cavity 30 is formed in the angled portion 72 of the well bore 12 at the location of the coal seam 16. As previously discussed, the enlarged cavity 30 may be formed by under reaming and other conventional techniques.

At step 710, the articulated well bore 40 is drilled to intersect the enlarged cavity 30 formed in the angled portion 72 of the well bore 12. At step 712, the well bore 144 for the pinnate well bore pattern is drilled through the articulated well bore 40 into the coal seam 16 extending from the enlarged cavity 30. After formation of the well bore 144, a first radius curving portion 150 of a lateral well bore 110 for the pinnate well bore pattern is drilled at step 714 extending from the well bore 144. A second radius curving portion 152 of the lateral well bore 110 is formed at step 716 extending from the first radius curving portion 150. The elongated portion 154 of the lateral well bore 110 is formed at step 718 extending from the second radius curving portion 152. At decisional step 720, a determination is made whether additional lateral well bores 110 are required. If additional lateral well bores 110 are desired, the method returns to step 714. If no additional lateral well bores 110 are desired, the method ends.

Figure 12:
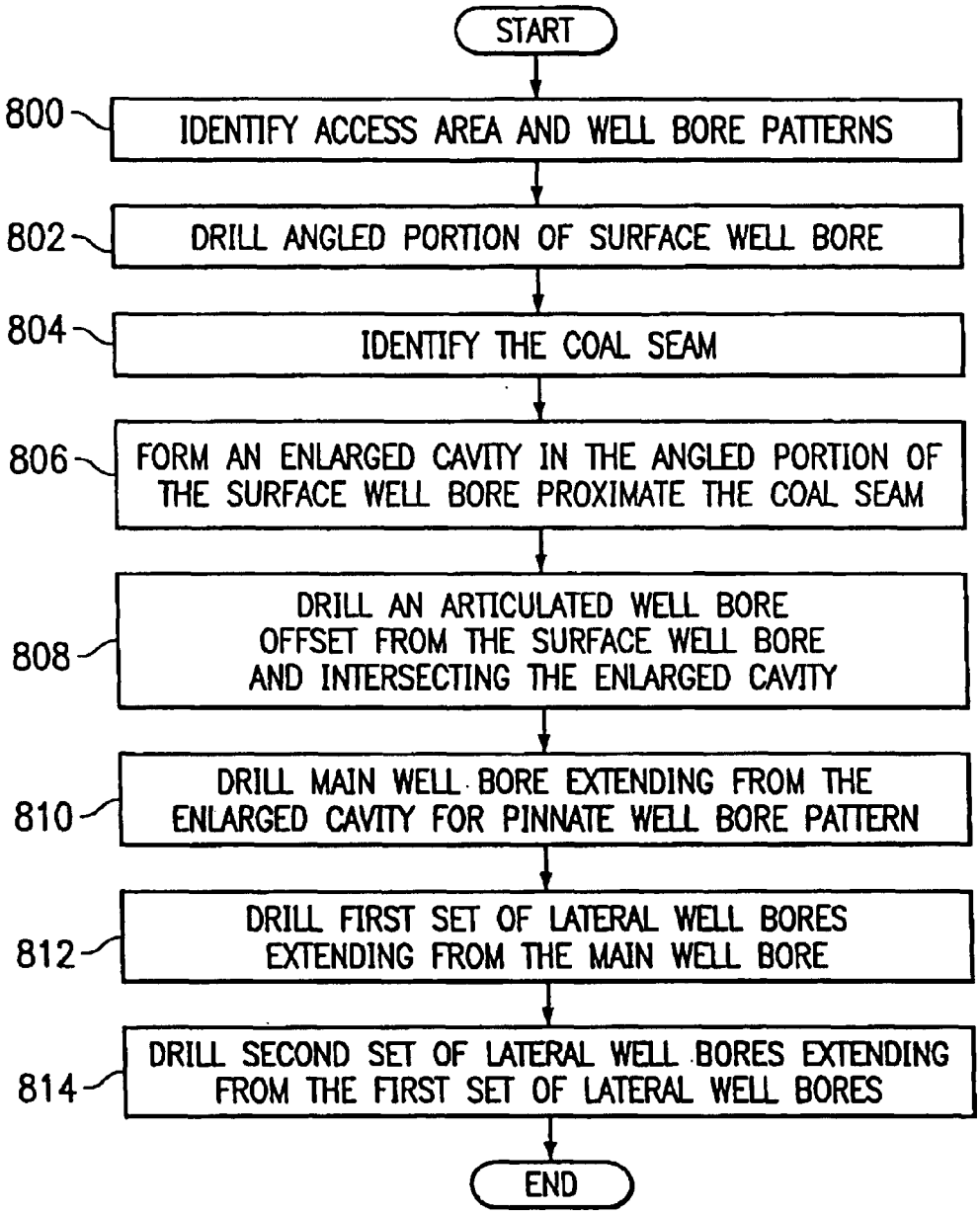
FIG. 12 is a flow diagram illustrating a method for accessing a subterranean zone from a limited surface area in accordance with another embodiment of the present invention.

FIG. 12 is a flow diagram illustrating a method for enhanced access to a subterranean resource, such as a coal seam 16, from a limited surface area in accordance with an embodiment of the present invention. In this embodiment, the method begins at step 800 in which areas to be accessed and well bore patterns for the areas are identified. Pinnate well bore patterns may be used to provide optimized coverage for the region. However, it should be understood that other suitable well bore patterns may also be used.

Proceeding to step 802, the angled portion 80 of the well bore 12 is formed. As described above in connection with FIG. 3, angular orientation of the angled portion 80 may vary to accommodate a desired intersection location of the coal seam 16 by the well bore 12. Next, at step 804, down hole logging equipment is utilized to exactly identify the location of the coal seam 16 in the well bore 12. At step 806, the enlarged cavity 30 is formed in the angled portion 80 of the well bore 12 at the location of the coal seam 16. As previously discussed, the enlarged cavity 30 may be formed by under reaming and other conventional techniques.

At step 808, the articulated well bore 40 is drilled to intersect the enlarged cavity 30 formed in the angled portion 80 of the well bore 12. At step 810, the well bore 104 for the pinnate well bore pattern is drilled through the articulated well bore 40 into the coal seam 16 extending from the enlarged cavity 30. After formation of the well bore 104, lateral well bores 110 for the pinnate well bore pattern are drilled at step 812. Lateral well bores 148 for the pinnate well bore pattern are formed at step 814.

Thus, the present invention provides greater access to subterranean resources from a limited surface area than prior systems and methods by decreasing the surface area required for dual well systems. For example, according to the present invention, the well bore 12 may be formed having an angled portion 20, 72 or 80 disposed between the surface 14 and the coal seam 16 to provide an offset between the surface location of the well bore 12 and the intersection of the well bore 12 with the coal seam 16, thereby accommodating formation of the articulated well bore 40 in close proximity to the surface location of the well bore 12.

Figure 13:
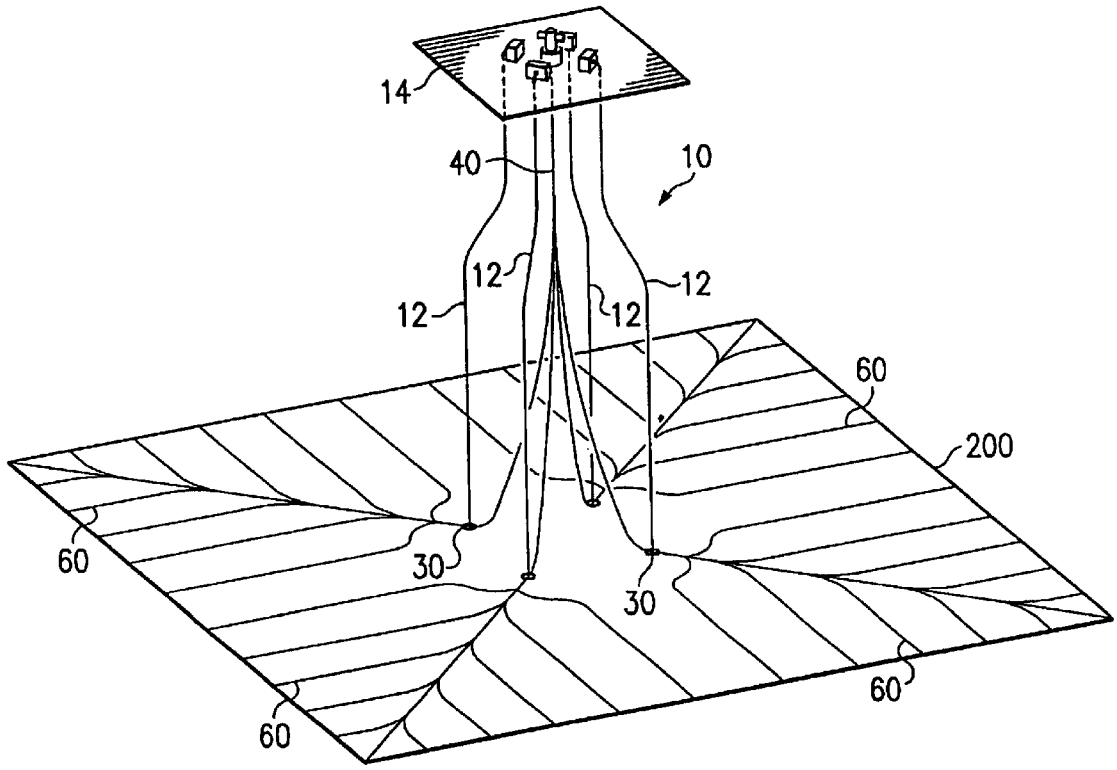
FIG. 13 is a diagram illustrating a system for accessing a subterranean zone in accordance with an embodiment of the present invention.

FIG. 13 is a diagram illustrating system 10 for accessing a subterranean zone 200 in accordance with an embodiment of the present invention. As illustrated in FIG. 13, the well bore 40 is disposed offset relative to a pattern of well bores 12 at the surface 14 and intersects each of the well bores 12 below the surface 14. In this embodiment, well bores 12 and 40 are disposed in a substantially nonlinear pattern in close proximity to each other to minimize the area required for the well bores 12 and 40 on the surface 14. In FIG. 13, well bores 12 are illustrated having a configuration as illustrated in FIG. 1; however, it should be understood that well bores 12 may be otherwise configured, for example, as illustrated in FIGS. 2–3.

Referring to FIG. 13, well bore patterns 60 are formed within the zone 200 extending from cavities 30 located at the intersecting junctions of the well bores 12 and 40 as described above. Well bore patterns 60 may comprise pinnate patterns, as illustrated in FIG. 13, or may include other suitable patterns for accessing the zone 200. As illustrated in FIG. 13, well bores 12 and 40 may be disposed in close proximity to each other at the surface 14 while providing generally uniform access to a generally large zone 200. For example, as discussed above, well bores 12 and 40 may be disposed within approximately 30 feet from each other at the surface while providing access to at least approximately 1000–1200 acres of the zone 200. Further, for example, in a nonlinear well bore 12 and 40 surface pattern, the well bores 12 and 40 may be disposed in an area generally less than five hundred square feet, thereby minimizing the footprint required on the surface 14 for system 10. Thus, the well bores 12 and 40 of system 10 may be located on the surface 14 in close proximity to each other, thereby minimizing disruption to the surface 14 while providing generally uniform access to a relatively large subterranean zone.

Although the present invention has been described with several embodiments, various changes and modifications may be suggested to one skilled in the art. It is intended that the present invention encompass such changes and modifications as fall within the scope of the appended claims.

What is claimed is:

1. A method for accessing a subsurface formation from a limited surface area, comprising:

forming a first well bore extending from the surface to a target zone, the well bore having an angled portion disposed between the target zone and the surface;

forming a second well bore extending from the surface to the target zone, the second well bore offset from the first well bore at the surface and intersecting the first well bore at a junction proximate the target zone; and forming through the second well bore a well bore pattern, the well bore pattern extending from the junction into the target zone.

2. The method of claim 1, wherein forming the first well bore comprises forming the angled portion extending from the surface to the target zone.

3. The method of claim 1, wherein forming the first well bore comprises forming a substantially vertical portion of the first well bore disposed between the angled portion and the surface.

4. The method of claim 1, wherein forming the first well bore comprises:

forming a first substantially vertical portion disposed between the angled portion and the surface; and forming a second substantially vertical portion disposed between the target zone and the angled portion.

5. The method of claim 1, further comprising forming an enlarged cavity in the target zone at an end of the well bore pattern proximate to the first well bore.

6. The method of claim 1, wherein forming the well bore pattern comprises forming a pinnate well bore pattern.

7. The method of claim 6, wherein forming the pinnate well bore pattern comprises forming a set of lateral well bores extending from a main well bore.

8. The method of claim 6, wherein forming the pinnate well bore pattern comprises:

forming a first set of lateral well bores extending from a main well bore; and forming a second set of lateral well bores extending from the first set of lateral well bores.

9. A system for accessing a subsurface formation from a limited surface area, comprising:

a first well bore extending from the surface to a target zone, the first well bore having an angled portion disposed between the target zone and the surface;

a second well bore extending from the surface to the target zone, the second well bore offset from the first well bore at the surface and intersecting the first well bore at a junction proximate the target zone; and a well bore pattern extending from the junction into the target zone.

10. The system of claim 9, wherein the angled portion of the first well bore extends from the surface to the target zone.

11. The system of claim 9, wherein the first well bore further comprises a substantially vertical portion disposed between the angled portion and the surface.

12. The system of claim 9, wherein the first well bore further comprises:

a first substantially vertical portion disposed between the angled portion and the surface; and a second substantially vertical portion disposed between the target zone and the angled portion.

13. The system of claim 9, further comprising an enlarged cavity disposed in the target zone at an end of the well bore pattern proximate to the first well bore.

14. The system of claim 9, wherein the well bore pattern comprises a pinnate well bore pattern.

15. The system of claim 14, wherein the pinnate well bore pattern comprises a set of lateral well bores extending from a main well bore.

16. The system of claim 14, wherein the pinnate well bore pattern comprises:

a first set of lateral well bores extending from a main well bore; and a second set of lateral well bores extending from the first set of lateral well bores.

17. A method for accessing a subsurface formation from a limited surface area, comprising:

forming a first well bore from the surface to a target zone of the subsurface formation, the first well bore having a substantially vertical portion and an angled portion;

forming a second well bore extending from the surface to the target zone, the second well bore offset from the first well bore at the surface and intersecting the first well bore at a junction proximate the target zone;

forming a well bore pattern extending from the junction into the target zone operable to collect resources; and removing resources from the target zone through the first well bore.

18. The method of claim 17, wherein forming the first well bore comprises:

forming the substantially vertical portion extending downwardly from the surface; and forming the angled portion extending from the substantially vertical portion to the target zone.

19. The method of claim 17, further comprising forming an enlarged cavity in the target zone at an end of the well bore pattern proximate to the first well bore.

20. The method of 17, wherein forming the well bore pattern comprises forming a pinnate well bore pattern.

21. The method of claim 20, wherein forming the pinnate well bore pattern comprises forming a plurality of lateral well bores extending from a main well bore.

22. The method of claim 20, wherein forming the pinnate well bore pattern comprises:

forming a first set of lateral well bores extending from a main well bore; and forming a second set of lateral well bores extending from the first set of lateral well bores.

23. The method of claim 17, wherein forming the first well bore comprises:

forming the substantially vertical portion extending downwardly from the surface;

forming the angled portion extending downwardly from an end of the substantially vertical portion; and forming another substantially vertical portion extending from an end of the angled portion to the target zone.

24. A system for extracting resources from a subsurface formation, comprising:

a first well bore extending from the surface to a target zone of the subsurface formation, the first well bore having a substantially vertical portion and an angled portion;

a second well bore extending from the surface to the target zone, the second well bore offset from the first well bore at the surface and intersecting the first well bore at a junction proximate the target zone;

a well bore pattern extending from the junction into the target zone operable to collect resources; and a production unit disposed in the first well bore operable to remove resources from the target zone through the first well bore to the surface.

25. The system of claim 24, wherein the substantially vertical portion of the first well bore extends downwardly from the surface, and wherein the angled portion of the well bore extends from the substantially vertical portion to the target zone.

26. The system of claim 24, further comprising an enlarged cavity formed in the target zone at an end of the well bore pattern proximate to the first well bore.

27. The system of 24, wherein the well bore pattern comprises a pinnate well bore pattern.

28. The system of claim 27, wherein the pinnate well bore pattern comprises a plurality of lateral well bores extending from a main well bore.

29. The system of claim 27, wherein the pinnate well bore pattern comprises:

a first set of lateral well bores extending from a main well bore; and a second set of lateral well bores extending from the first set of lateral well bores.

30. The method of claim 24, wherein the first well bore comprises:

the substantially vertical portion extending downwardly from the surface;

the angled portion extending downwardly from an end of the substantially vertical portion; and another substantially vertical portion extending from an end of the angled portion to the target zone.

* * * * *

UNITED STATES PATENT AND TRADEMARK OFFICE

CERTIFICATE OF CORRECTION

PATENT NO. : 7,036,584 B2 
APPLICATION NO. : 10/188141
DATED : May 2, 2006
INVENTOR(S) : Joseph A. Zupanick and Monty H. Rial It is certified that error appears in the above-identified patent and that said Letters Patent is hereby corrected as shown below:

Item (74) on the cover page of the patent, replace: "Baker Botts L.L.P." with --Fish & Richardson P.C.--

Column 17, line 28, cancel the text beginning with "1. A method for accessing" to and ending "the target zone." in column 17, Line 40, an insert the following claim:

--1. A method for accessing a subsurface formation from a limited surface area, comprising:
forming a first well bore extending from the surface to a target zone, the well bore having an angled portion disposed between the target zone and the surface;
forming a second well bore intersecting and extending through the first well bore at a junction proximate the target zone; and
forming through the second well bore a well bore pattern, the well bore pattern extending from the junction into the target zone.--

Column 18, Line 1, cancel the text beginning with "9. A system for accessing" to and ending "the target zone." in column 18, Line 11, an insert the following claim:

--9. A system for accessing a subsurface formation from a limited surface area, comprising:
a first well bore extending from the surface to a target zone, the first well bore having an angled portion disposed between the target zone and the surface;
a second well bore intersecting and extending through the first well bore at a junction proximate the target zone; and
a well bore pattern extending from the junction into the target zone.--

Column 18, Line 39, cancel the text beginning with "17. A method for accessing" to and ending "the first well bore." in column 18, Line 52, an insert the following claim:

--17. A method for accessing a subsurface formation from a limited surface area, comprising:
forming a first well bore from the surface to a target zone of the subsurface formation, the first well bore having a substantially vertical portion and an angled portion;
forming a second well bore intersecting and extending through the first well bore at a junction proximate the target zone;
forming a well bore pattern extending from the junction into the target zone operable to collect resources; and

UNITED STATES PATENT AND TRADEMARK OFFICE

CERTIFICATE OF CORRECTION

PATENT NO. : 7,036,584 B2
APPLICATION NO. : 10/188141
DATED : May 2, 2006
INVENTOR(S) : Joseph A. Zupanick and Monty H. Rial It is certified that error appears in the above-identified patent and that said Letters Patent is hereby corrected as shown below:

removing resources from the target zone through the first well bore.--

Column 19, Line 16, cancel the text beginning with "24. A system for extracting" to and ending "to the surface." in column 17, Line 40, an insert the following claim:

--24. A system for extracting resources from a subsurface formation, comprising:
a first well bore extending from the surface to a target zone of the subsurface formation, the first well bore having a substantially vertical portion and an angled portion;
a second well bore intersecting and extending through the first well bore at a junction proximate the target zone;
a well bore pattern extending from the junction into the target zone operable to collect resources; and
a production unit disposed in the first well bore operable to remove resources from the target zone through the first well bore to the surface.--

Signed and Sealed this

Tenth Day of November, 2009

David J. Kappos

David J. Kappos
*Director of the United States Patent and Trademark Office*